US006354563B1

(12) United States Patent
Yoeda et al.

(10) Patent No.: US 6,354,563 B1
(45) Date of Patent: Mar. 12, 2002

(54) ELECTROMAGNETIC DRIVE VALVE AND METHOD FOR CONTROLLING SAME

(75) Inventors: Keiji Yoeda, Numazu; Yoshihiro Iwashita, Nagaizumi-cho; Isao Matsumoto, Susono, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/563,156

(22) Filed: May 1, 2000

(30) Foreign Application Priority Data

May 11, 1999 (JP) ..... 11-130101

(51) Int. Cl.[7] ..... F01L 9/04
(52) U.S. Cl. ..... 251/129.04; 123/90.11
(58) Field of Search ..... 251/128.04; 123/90.11; 700/46, 282, 302

(56) References Cited

U.S. PATENT DOCUMENTS 4,485,338 A * 11/1984 Matsuura et al. ..... 318/569
4,845,416 A * 7/1989 Scholl et al. ..... 251/129.04 X
5,069,422 A * 12/1991 Kawamura ..... 251/129.04 X
5,983,847 A * 11/1999 Miyoshi et al. ..... 123/90.11
6,024,059 A * 2/2000 Kamimaru et al. ..... 123/90.11
6,089,535 A * 7/2000 Mizutani et al. .... 251/129.04 X
6,152,094 A * 11/2000 Kirschbaum ..... 123/90.11

FOREIGN PATENT DOCUMENTS

JP B2-7-111127 11/1995

* cited by examiner

*Primary Examiner*—Kenneth Bomberg
*Assistant Examiner*—Eric Keasel
(74) *Attorney, Agent, or Firm*—Oliff & Berridge, PLC

(57) ABSTRACT

An electromagnetic drive valve always maintains an optimal waveform of a current supplied to electromagnets for driving an armature. The waveform of an instruction current to each coil is changed in accordance with changes of external disturbances affecting a valve body based on the pressure in the cylinders of an internal combustion engine, the sliding resistance on a bearing, and the like.

21 Claims, 17 Drawing Sheets

Tp
Tp3
Tp2
Tp1
REFERENCE ELAPSED TIME Tbase

Tatt
Tatt3
Tatt2
Tatt1
REFERENCE ELAPSED TIME Tbase

Iatt
Iatt3
Iatt2
Iatt1
REFERENCE ELAPSED TIME Tbase

Ihold
Ihold0
T1
T2
T3
REFERENCE ELAPSED TIME Tbase

FIG.15A
FIG.15B
FIG.15C
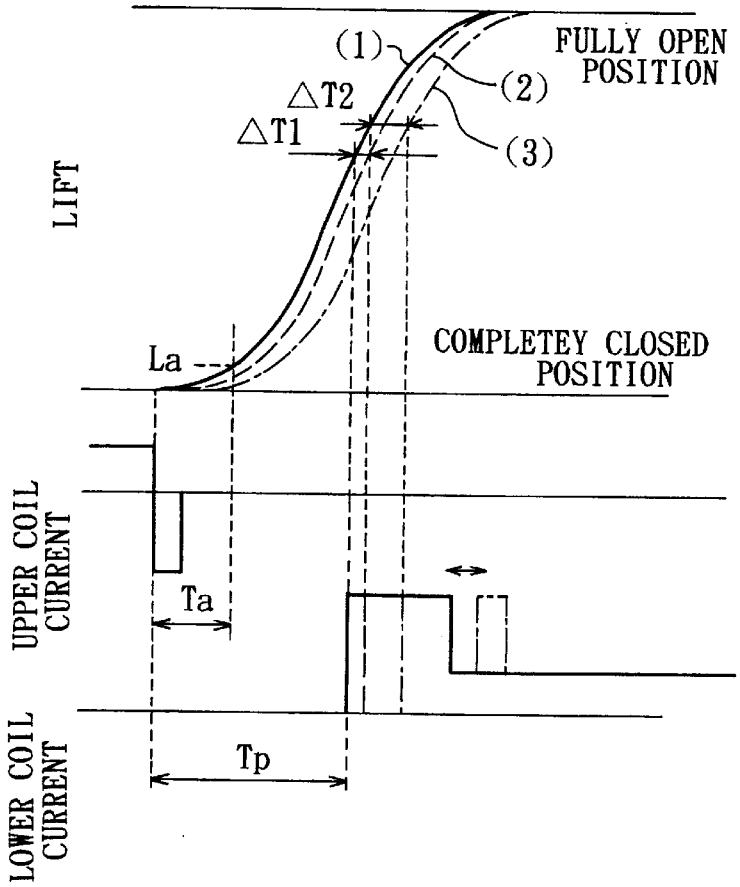
FIG. 16
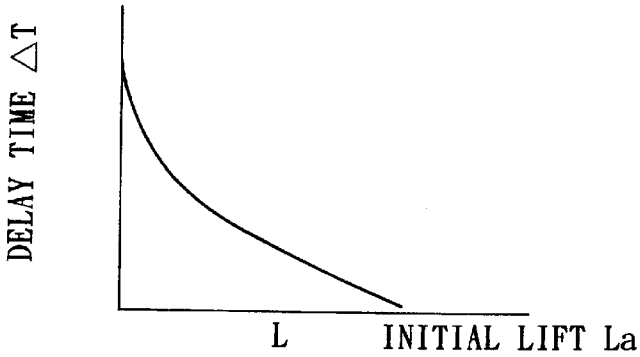

ELECTROMAGNETIC DRIVE VALVE AND METHOD FOR CONTROLLING SAME

INCORPORATION BY REFERENCE

The disclosure of Japanese Patent Application No. HEI 11-130101 filed on May 11, 1999 including the specification, drawings and abstract is incorporated herein by reference in its entirety.

BACKGROUND OF THE INVENTION

1. Field of the Invention

The invention relates to an electromagnetic drive valve and a method for controlling the electromagnetic drive valve that drives a valve body in opening and closing directions by drawing an armature through the use of electromagnets and, more particularly, to an electromagnetic drive valve that is suitable for optimal control of the waveform of an electromagnet-energizing current.

2. Description of the Related Art

A known electromagnetic drive valve (described in, for example, Examined Japanese Patent Application Publication No. HEI 7-111127) has a valve body that serves as an intake or exhaust valve in an internal combustion engine, an armature that cooperates with the valve body, and electromagnets disposed at opposite sides of the armature in the directions of displacement of the armature. The electromagnetic drive valve opens and closes the valve body by supplying an exciting current having a predetermined waveform alternately to the electromagnets at timing synchronous with the crank angle of the internal combustion engine.

When the valve body of an electromagnetic drive valve is driven in the opening or closing direction, external forces caused by the pressure in the cylinder, the sliding resistance on the bearing, and the like, act on the valve body, as external disturbances. The magnitude of such an external disturbance varies every operation cycle of the valve body. The "time delay" of the start of displacement of the valve body, which is caused by an effect of surface tension of oil films existing on contact surfaces of the armature and the electromagnets, also varies every operation cycle of the valve body. Therefore, if an exciting current having a pre-set waveform is supplied to the electromagnets of the electromagnetic drive valve, an appropriate waveform of displacement of the valve body may not be obtained, depending on variations in the external disturbances and the time delay. For example, if an external disturbance that impedes the displacement of the valve body increases, the valve body may fail to reach a predetermined end of displacement. If such an external disturbance decreases, the displacement velocity of the valve body at the time of displacement to the predetermined end may become excessively high, thereby causing problems of an increased operation sound level of the electromagnetic drive valve and the like.

SUMMARY OF THE INVENTION

Accordingly, it is an aspect of the invention to provide an electromagnetic drive valve capable of always providing an optimal waveform of current to be supplied to electromagnets for driving an armature.

In order to achieve the aforementioned and/or other aspects of the invention, an electromagnetic drive valve in accordance with one embodiment of the invention includes a valve body that is movable between a first displacement end and a second displacement end based on a displacement request. Additionally, an electromagnet attracts an armature that cooperates with the valve body, and a current supply supplies a current to the electromagnet. Furthermore, a position detector detects a position of the valve body between the first displacement end and the second displacement end when the valve body is moved from the first displacement end toward the second displacement end, and a controller changes a waveform of the current to be supplied from the current supply to the electromagnet, based on at least the position of the valve body detected by the position detector.

The position of the valve body during a displacement is affected by changes of the time delay between the output of the displacement request and the start of displacement of the valve body and changes of external disturbances received by the valve body during the displacement. The kinetic energy applied to the armature changes if the waveform of the current to be supplied to the electromagnet is changed. Therefore, by changing the waveform of the current based on the position of the valve body, the electromagnetic drive valve is able to provide an optimal waveform of the current that compensates for the changes of the delay time or changes of external disturbances.

The aforementioned changes of the delay time and the changes of external disturbances also affect the elapsed time to the time point at which the valve body reaches a predetermined position, and the velocity of the valve body. Therefore, the electromagnetic drive valve may further include a time detector that detects an elapsed time to a time point at which the valve body reaches at least one position located between the first displacement end and the second displacement end, or a velocity detector that detects a velocity of the valve body.

BRIEF DESCRIPTION OF THE DRAWINGS

The foregoing and further aspects, features and advantages of the invention will become apparent from the following description of preferred embodiments with reference to the accompanying drawings, wherein like numerals are used to represent like elements and wherein:

FIG. 15A is a diagram shown in three waveforms of lift of the valve body with different delay times;

FIG. 15B shows a waveform of the instruction current supplied to an upper coil;

FIG. 15C shows a waveform of the instruction current supplied to a lower coil;

FIG. 16 indicates a relationship between the initial lift and the delay time;

DETAILED DESCRIPTION OF PREFERRED EMBODIMENTS

Preferred embodiments of the invention will be described hereinafter with reference to the accompanying drawings.

Figure 1:
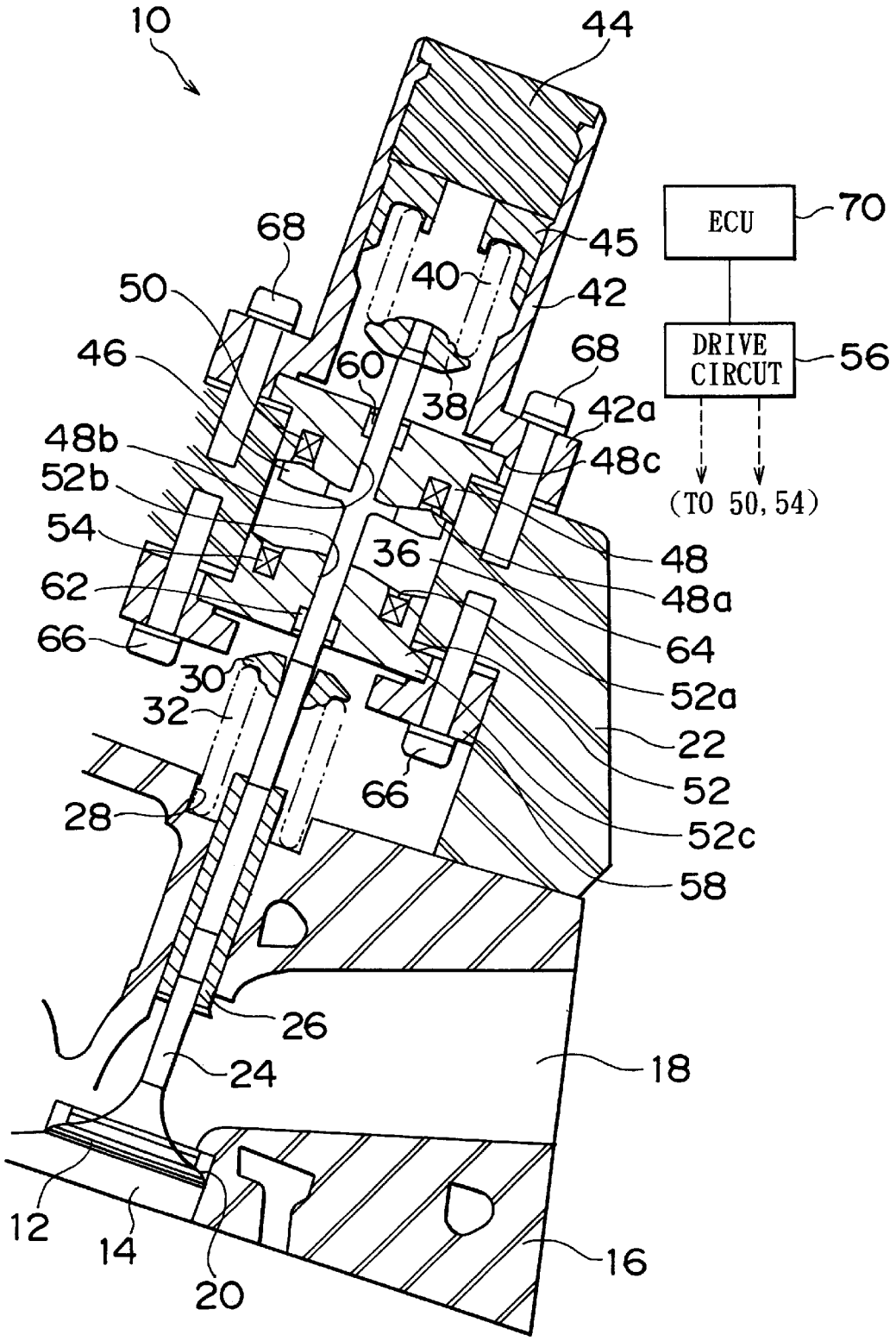
FIG. 1 is an illustration of a construction of an electromagnetic drive valve according to the invention.

FIG. 1 illustrates a construction of an electromagnetic drive valve 10 according to an embodiment of the invention. The electromagnetic drive valve 10 has a valve body 12 that serves as an intake valve or an exhaust valve of an internal combustion engine. The valve body 12 is disposed in a lower head 16 so as to be exposed to a combustion chamber 14 of the internal combustion engine. The lower head 16 has a port 18. The port 18 has a valve seat 20 for the valve body 12. The port 18 communicates with the combustion chamber 14 when the valve body 12 separates from the valve seat 20. When the valve body 12 is seated on the valve seat 20, the port 18 is disconnected in communication from the combustion chamber 14. An upper head 22 is fixed to an upper portion of the lower head 16.

The valve body 12 is provided integrally with a valve shaft 24 extending upward from the valve body 12. The valve shaft 24 is retained movably in the directions of an axis thereof by a valve guide 26 fixed to the lower head 16. A sensor for detecting the amount of lift of the valve body 12 is incorporated in the valve guide 26. A spring retainer portion 28 having a cylindrical shape is formed around an upper portion of the valve guide 26. A lower retainer 30 is fixed to an upper end portion of the valve shaft 24. Disposed between the lower retainer 30 and a bottom surface of the spring retainer portion 28 is a lower spring 32 that generates forces in such directions as to move the lower retainer 30 and the spring retainer portion 28 away from each other. The lower spring 32 urges the valve body 12 via the lower retainer 30, in a valve closing direction (upward in FIG. 1).

An upper end portion of the valve shaft 24 contacts a lower end surface of an armature shaft 36. The armature shaft 36 is a rod-shaped member formed from a non-magnetic material. An upper retainer 38 is fixed to an upper end portion of the armature shaft 36. An upper portion of the upper retainer 38 contacts a lower end portion of an upper spring 40. The upper spring 40 is surrounded by a cylindrical upper cap 42. An adjuster bolt 44 is screwed to an upper portion of the cylindrical upper cap 42. The upper spring 40 is supported at its upper end portion by the adjuster bolt 44, with a spring seat 45 disposed therebetween. The upper spring 40 urges the armature shaft 36 downward (i.e., in the valve body-opening direction) via the upper retainer 38.

An armature 46 is joined to an outer peripheral surface of an intermediate portion of the armature shaft 36 in the direction of the axis. The armature 46 is an annular member formed from a soft magnetic material. An upper core 48 and an upper coil 50 are disposed above the armature 46. A lower core 52 and a lower coil 54 are disposed below the armature 46. The upper coil 50 and the lower coil 54 are disposed in annular grooves 48*a*, 52*a* formed in side surfaces of the upper core 48 and the lower core 52, respectively, that face the armature 46.

The upper coil 50 and the lower coil 54 are electrically connected to a drive circuit 56. The drive circuit 56 generates an instruction signal in accordance with a control signal supplied from an electronic control unit (hereinafter, referred to as "ECU") 70, through pulse width modulation (PWM), and supplies the instruction signal to the upper coil 50 and the lower coil 54.

The upper core 48 and the lower core 52 have through-holes 48*b*, 52*b*, respectively, that extend through central portions of the cores. A bush 60 is disposed in an upper end portion of the through-hole 48*b* of the upper core 48. A bush 62 is disposed in a lower end portion of the through-hole 52*b* of the lower core 52. The armature shaft 36 extends through the through-holes 48*b*, 52*b*, and is retained by the bushes 60, 62 so that the armature shaft 36 is movable in the directions of the axis.

Each of the upper core 48 and the lower core 52 has, in its upper or lower end portion, a flange 48*c*, 52*c*. The upper core 48 and the lower core 52 are fitted into a cylindrical core-retaining space 64 that is formed in the upper head 22, in such a manner that the flanges 48*c*, 52*c* of the upper core 48 and the lower core 52 sandwich the upper head 22 from upper and lower surfaces thereof. The core-retaining space 64 is supplied with a lubricating oil from an oil-supplying passage (not shown). The lubricating oil lubricates sliding surfaces of the armature shaft 36 and the bushes 60, 62.

The cylindrical upper cap 42 has, in its lower end portion, a flange 42*a*. The flange 42*a* extends so as to cover the flange 48*c* of the upper core 48 from above. A lower cap 58 is disposed on the lower surface of the upper head 22 in such a manner that the lower cap 58 covers the flange 52*c* of the lower core 52 from below. Fixing bolts 68 extend through the flange 42*a* of the cylindrical upper cap 42, and are fastened to the upper head 22. Fixing bolts 66 extend through the lower cap 58, and are fastened to the upper head 22. In this manner, the upper core 48 and the lower core 52 are fixed to the upper head 22, with a predetermined interval left between the upper core 48 and the lower core 52. The adjuster bolt 44 is pre-adjusted so that a neutral position of the armature 46 comes to an intermediate point between the upper core 48 and the lower core 52.

The operation of the electromagnetic drive valve 10 will now be described. When exciting current is supplied to the upper coil 50, magnetic fluxes are generated from the upper coil 50. Due to the magnetic fluxes, an electromagnetic attraction force acts on the armature 46 in a direction toward the upper core 48, so that the armature 46 moves toward the upper core 48, overcoming the urging force from the upper spring 40. When the armature 46 is moved to contact the upper core 48, the valve body 12 becomes seated on the valve seat 20, that is, the valve body 12 assumes a completely closed state. In the description below, the position at which the armature 46 contacts the upper core 48 is referred to as "completely closed position" of the armature 46 or the valve body 12.

When the supply of exciting current to the upper coil 50 is discontinued while the valve body 12 has remained closed, the electromagnetic attraction force needed to hold the armature 46 at the completely closed position disappears. Therefore, the armature shaft 36 immediately starts to move downward due to the force from the upper spring 40.

When the armature shaft 36 moves downward from the completely closed position, the valve body 12 separates from the valve seat 20, that is, the valve body 12 assumes an open state. If the lower coil 54 is supplied with exciting current when the downward displacement of the armature shaft 36 reaches a predetermined value, electromagnetic attraction force acts on the armature 46 in a direction toward the lower core 52.

Then, the armature 46 moves until it contacts the lower core 52, overcoming the force from the lower spring 32. Hereinafter, the position at which the armature 46 contacts the lower core 52 is referred to as "fully open position" of the armature 46 or the valve body 12. If the supply of exciting current to the lower coil 54 is discontinued while the armature 46 is at the fully open position, the electromagnetic attraction force needed to hold the armature 46 at the fully open position disappears. Therefore, the armature shaft 36 immediately starts to move upward, due to the force from the lower spring 32.

If the upper coil 50 is supplied with exciting current when the upward displacement of the armature shaft 36 reaches a predetermined value, the armature 46 moves to the completely closed position, so that the valve body 12 assumes the completely closed state again.

Figures 2A, 2B:
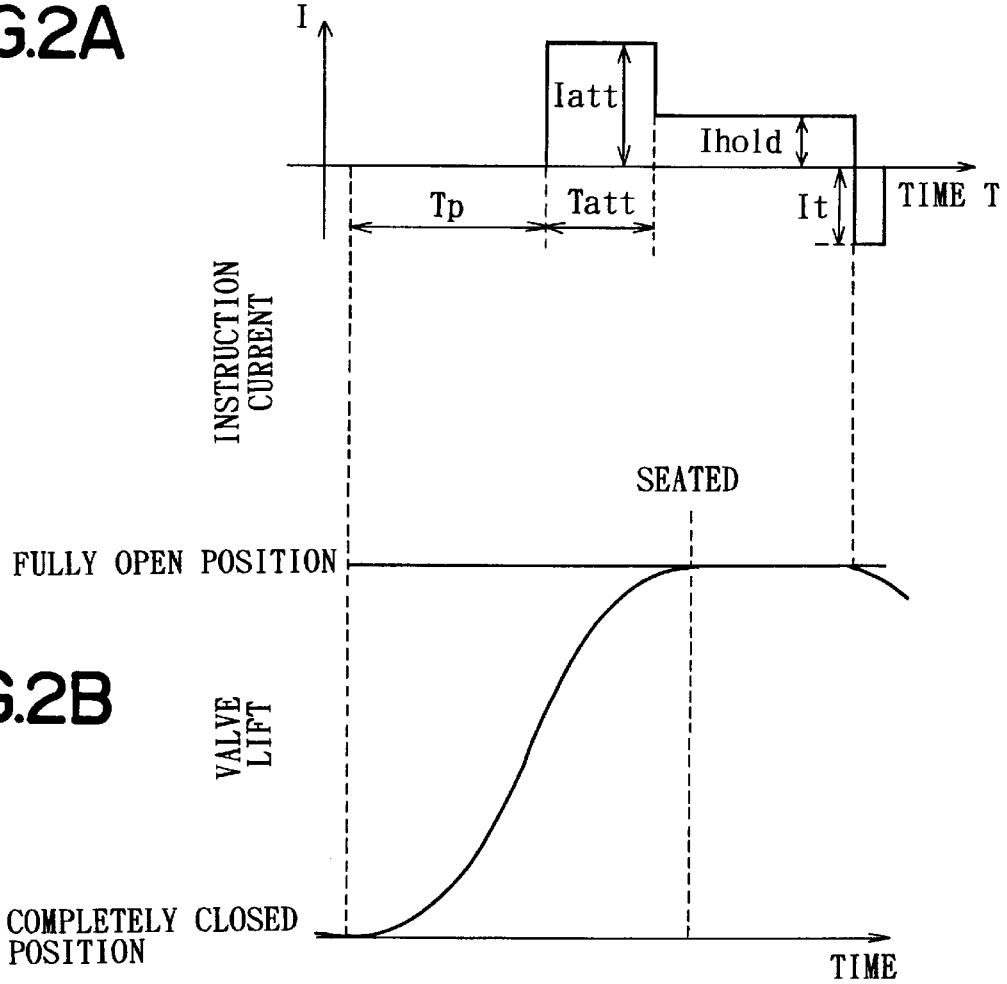
FIG. 2A is a diagram showing a waveform of an instruction current that is supplied to each coil.
FIG. 2B is a diagram showing a waveform of lift of a valve body.

FIG. 2A shows an example of the waveform of an instruction current I that is supplied to the lower coil 54 in order to move the valve body 12 from the completely closed position to the fully open position. FIG. 2B indicates the displacement of the valve body 12 occurring when the instruction current I as indicated in FIG. 2A is supplied to the lower coil 54.

As indicated in FIG. 2A, the instruction current I supplied to the lower coil 54 is held at an attraction current Iatt for an attraction period Tatt following the elapse of a pause period Tp after a request to open the valve body 12 is outputted (that is, after the supply of a release current It (described below) to the upper coil 50 is started). Then, immediately before the valve body 12 reaches the fully open position, the value of the instruction current I is changed to a hold current Ihold that is less than the attraction current Iatt. While the hold current Ihold is being supplied to the lower coil 54, the valve body 12 is held at the fully open position. After that, at a time point at which a request to close the valve body 12 is outputted, the instruction current I is changed to the release current It, which is in the direction opposite to the direction of the hold current Ihold, so that the valve body 12 starts to move toward the completely closed position. Similarly, the upper coil 50 is supplied with the instruction current I having a waveform as indicated in FIG. 2A so as to drive the valve body 12 to the completely closed position.

The instruction current supplied to each coil 50, 54 is defined by the pause period Tp, the attraction period Tatt, the attraction current Iatt, the hold current Ihold, and the release current It. Of these five parameters, the parameters Tp, Tatt, Iatt and Ihold are set so that the valve body 12 reaches the fully open position or the completely closed position when the displacement velocity of the valve body 12 becomes substantially zero. This manner of setting the parameters makes it possible to reduce the level of noise caused by the contact between the armature 46 and the cores 48, 52, and the level of noise caused by the contact of the valve body 12 with the valve seat 20 while ensuring the movements of the valve body 12 to the completely closed position and the fully open position.

However, when the valve body 12 is moved, various uncertain external forces act on the valve body 12 as external disturbances that impede the displacement of the valve body 12. For example, the sliding resistance between the valve shaft 24 and the valve guide 26, and the sliding resistance between the armature shaft 36 and the bushes 60, 62 are external disturbances in such directions as to impede the displacements of the valve body 12. These sliding resistances can vary every operation cycle of the valve body 12. Furthermore, in a case where the valve body 12 serves as an exhaust valve, the difference between the combustion pressure (high pressure) in the combustion chamber 14 and the pressure in the port 18 becomes an external disturbance in such a direction as to impede the displacement of the valve body 12, when the valve body 12 is open. The combustion pressure can also vary in accordance with the combustion state from a combustion cycle to another. In a case where the valve body 12 serves as an intake valve, a stream of intake air affects the valve body 12 as an external disturbance. In this case, too, the external disturbance affecting the valve body 12 varies since the air intake state varies in accordance with the combustion state in a preceding combustion cycle.

Thus, external disturbances on the valve body 12 vary every operation cycle. In accordance with variations of the external disturbances, the kinetic energy that is lost during the displacement of the valve body 12 also varies. Therefore, if a current of a pre-set waveform is used as an instruction current to the upper coil 50 and the lower coil 54, it becomes impossible to appropriately drive the valve body 12 due to variations in the external disturbances in some cases.

Figure 3:
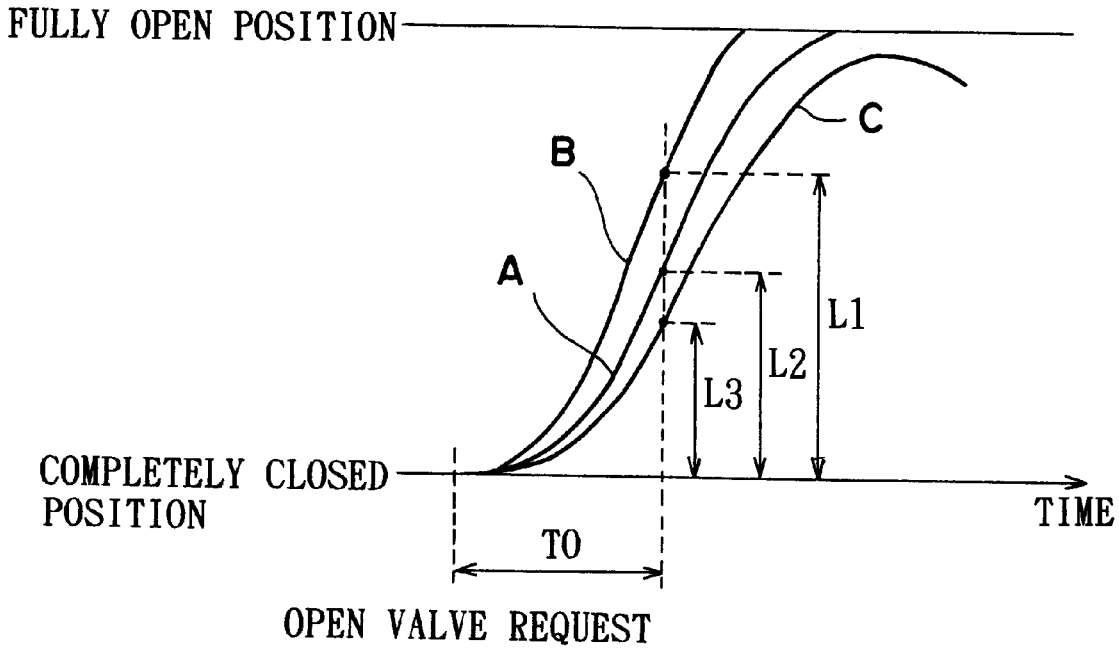
FIG. 3 indicates changes in the reference lift caused by external disturbances affecting the valve body.

FIG. 3 shows waveforms of lift of the valve body 12 moving from the completely closed position to the fully open position when an external disturbance on the valve body 12 varies under a condition that the waveform of the instruction current to the lower coil 54 is fixed. In FIG. 3, a curve A indicates an optimal waveform of valve lift in which the displacement velocity of the valve body 12 becomes substantially zero when the valve body 12 reaches the fully open position. A curve B indicates a waveform of valve lift in which a force acting on the valve body 12 in the opening direction becomes excessively large (that is, the external disturbance in such a direction as to impede the displacement of the valve body 12 is less in the curve B than in the curve A) and, therefore, the displacement velocity of the valve body 12 when the valve body 12 reaches the fully open position is relatively large. In the case of the curve B, the armature 46 comes into contact with the lower core 52 at a relatively high velocity, so that an increased level of operation noise of the electromagnetic drive valve 10 results. A curve C in FIG. 3 indicates a waveform of valve lift in which the force acting on the valve body 12 in the opening direction is insufficient (that is, the external disturbance in such a direction as to impede the displacement of the valve body 12 is greater in the curve C than in the curve A) and, therefore, the valve body 12 does not reach the fully open position. In the case of the curve C, it becomes impossible to open and close the valve body 12.

As indicated in FIG. 3, the lift of the valve body 12 at the elapse of a predetermined time T0 following the output of the request to open the valve body 12 (hereinafter, referred to as "reference lift Lbase") varies as in L1, L2, L3 in accordance with the external disturbances affecting the valve body 12, that is, in accordance with the kinetic energy that is lost by the valve body 12. That is, as the kinetic energy lost by the valve body 12 becomes less, the reference lift Lbase becomes greater, and it becomes more appropriate to determine that the electromagnetic force applied to the armature 46 needs to be reduced. The magnitude of kinetic energy applied to the armature 46 by electromagnetic attraction force depends on the waveform of the instruction current supplied to each coil. Therefore, in the embodiment, the waveform of the instruction current I is determined based on the reference lift Lbase of the valve body 12.

This and below-described embodiments are described in conjunction with the displacement of the valve body 12 from the completely closed position to the fully open position. However, techniques described herein are also applicable in similar manners to the displacement of the valve body 12 from the fully open position to the completely closed position.

FIGS. 4A to 4D indicate a relationship between the reference lift Lbase and the pause period Tp, a relationship between the reference lift Lbase and the attraction period Tatt, a relationship between the reference lift Lbase and the attraction current Iatt, and a relationship between the reference lift Lbase and the hold current Ihold, respectively. These relationships were empirically determined. In the relationships between the parameters, the valve body 12 reaches the fully open position at a displacement velocity substantially reduced to zero (as indicated by the curve A in FIG. 3), under conditions where various external disturbances affect the valve body 12.

Figure 4A:
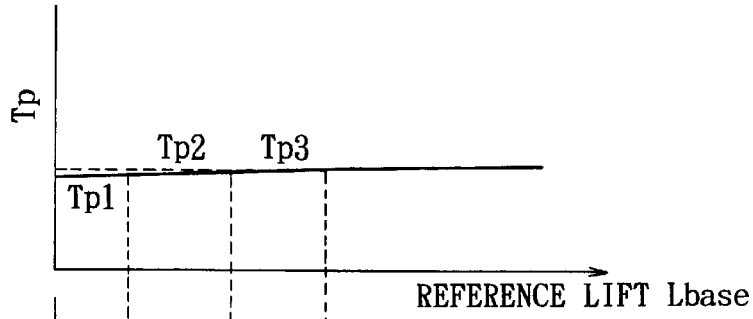
FIG. 4A indicates a relationship between the reference lift and the pause period.
Figure 4B:
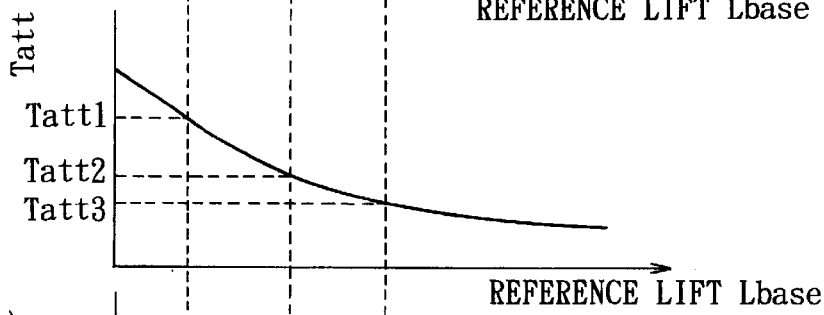
FIG. 4B indicates a relationship between the reference lift and the attraction period.
Figure 4C:
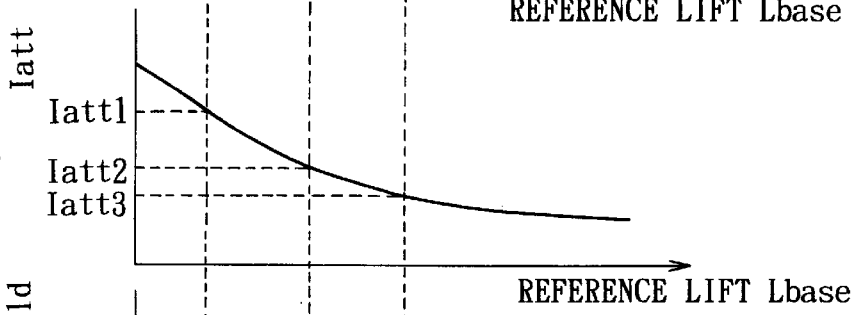
FIG. 4C indicates a relationship between the reference lift and the attraction current.
Figure 4D:
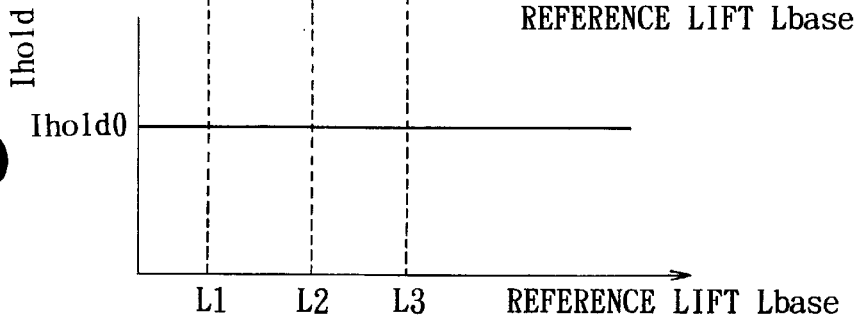
FIG. 4D indicates a relationship between the reference lift and the hold current.

The electromagnetic attraction force applied to the armature 46 depends on the total amount of attraction current Iatt supplied, that is, the product of multiplication of the attraction current Iatt and the attraction period Tatt. Therefore, the attraction period Tatt and the attraction current Iatt are set so that they decrease with increases in the reference lift Lbase as indicated in FIGS. 4B and 4C. The pause Tp and the hold current Ihold are kept substantially constant regardless of the reference lift Lbase. However, since the electrification start timing can be delayed further as the external disturbance on the valve body 12 becomes smaller in magnitude, the pause period Tp is set so as to gradually decrease slightly with increases in the reference lift Lbase as indicated in FIG. 4A. The hold current Ihold is kept at a constant value Ihold0 regardless of the reference lift Lbase as indicated in FIG. 4D.

When the reference lift Lbase is L1, L2 and L3, waveforms of the instruction current I defined byparameters (Tp1, Tatt1, Iatt1, Ihold0), (Tp2, Tatt2, Iatt2, Ihold0), and (Tp3, Tatt3, Iatt3, Ihold0) are used, respectively, as indicated in FIGS. 4A to 4D.

By setting the parameters (Tp, Tatt, Iatt, Ihold) based on the reference lift Lbase, the embodiment is able to compensate for variations in the external disturbances and, therefore, provide an optimal waveform of the instruction current I. That is, the embodiment is able to reliably open and close the valve body 12 without increasing the operation noise level of the electromagnetic drive valve 10.

It is to be noted herein that when the valve body 12 is moved from the completely closed position to the fully open position, the valve body 12 can be moved to a point beyond the neutral position (i.e., a position in the valve opening direction from the neutral position) by the force from the upper spring 40 and the lower spring 32 even if no electromagnetic force is applied to the armature 46. Furthermore, in order to efficiently apply electromagnetic force to the armature 46, it is effective to start electrifying the coil 50 or 54 of the upper core 48 or the lower core 52, respectively, after the armature at 46 approaches the upper core 48 or the lower core 52, respectively. Considering this, the pause period Tp is set so that the supply of the attraction current Iatt starts at a time point after the valve body 12 passes the neutral position.

When the valve body 12 is moved from the completely closed position to the fully open position, the differential pressure between the port 18 and the combustion chamber 14 decreases as the lift of the valve body 12 increases. When the valve body 12 comes close to the neutral position, the pressure in the port 18 and the pressure in the combustion chamber 14 become substantially equal. Therefore, after the valve body 12 passes the neutral position, substantially no variation of external disturbances caused on the valve body 12 by the differential pressure occurs.

If the predetermined time T0 (see FIG. 3) is set such that the reference lift Lbase becomes slightly smaller than a half of the maximum lift of the valve body 12 (i.e., the distance between the completely closed position and the fully open position), it becomes possible to detect a reference lift Lbase in which variations of external disturbances caused by the differential pressure are reflected to a great extent in a condition where no electromagnetic force acts on the armature 46. Therefore, it becomes possible to more appropriately set the waveform of the instruction current I in accordance with variations of external disturbances.

Figure 5:
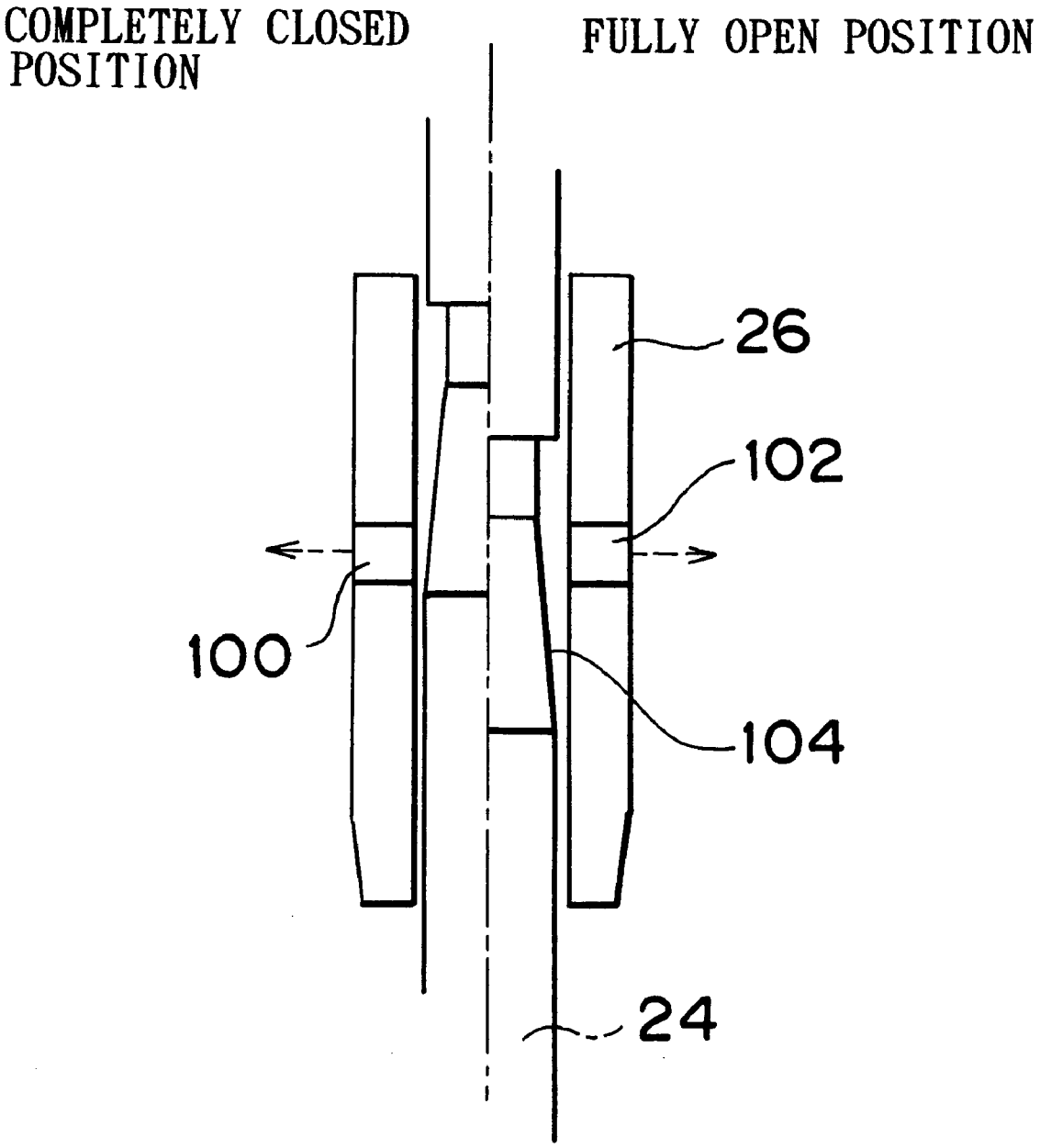
FIG. 5 illustrates a construction for detecting the lift of the valve body.

A construction for detecting the lift of valve body 12 in the embodiment will be described with reference to FIG. 5. FIG. 5 is a sectional view of the valve guide 26 in the embodiment taken along the axis thereof. In FIG. 5, a left-side half of the illustration shows a state in which the valve body 12 is at the completely closed position, and a right-side half of the illustration shows a state in which the valve body 12 is at the fully open position.

Referring to FIG. 5, the valve guide 26 is provided with a pair of gap sensors (e.g., of an eddy-current type) 100, 102 that face each other across the valve shaft 24 in the direction of a diameter of the valve shaft 24. Each of the gap sensors 100, 102 is electrically connected to the ECU 70, and outputs to the ECU 70 a voltage signal corresponding to the distance to an outer peripheral surface of the valve shaft 24.

The valve shaft 24 has a tapered portion 104 that is progressively narrowed toward an upper side. The position of the tapered portion 104 is defined so that when the valve body 12 is at the completely closed position (in the left-side half of FIG. 5), a portion near the larger-diameter end of the tapered portion 104 of the valve shaft 24 faces the gap sensors 100, 102, and so that when the valve body 12 is at the fully open position (in the right-side half of FIG. 5), a portion near the smaller-diameter end of the tapered portion 104 faces the gap sensors 100, 102. Therefore, as the lift of the valve body 12 increases with movement from the completely closed position, the distance from each gap sensor 100, 102 to the outer peripheral surface of the valve shaft 24 increases and, therefore, the output voltage V of the gap sensors 100, 102 (a mean value of the output voltages of the sensors) gradually increases.

Figure 6:
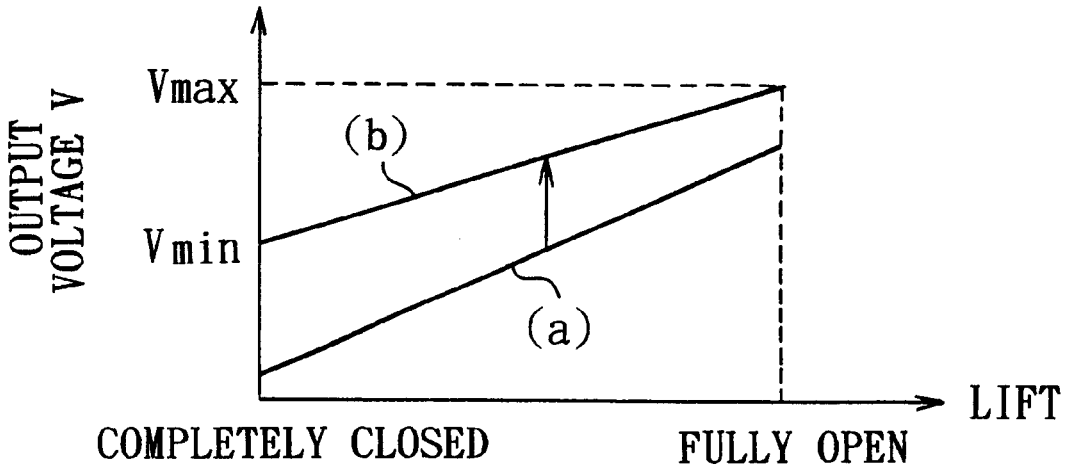
FIG. 6 indicates a relationship between the lift of the valve body detected by the construction shown in FIG. 5 and the output voltage of a gap sensor.

FIG. 6 indicates a relationship between the lift and the sensor output voltage V between the completely closed position and the fully open position. As indicated by a line (a) in FIG. 6, the output voltage V increases as the lift of the valve body 12 increases. However, if a zero point variation or a gain due to a temperature drift of the gap sensors 100, 102 occurs, the output voltage V changes while the lift remains the same, as indicated by a line (b). Therefore, a normalized value Vs of the output voltage V is calculated from a value of the output voltage V provided when the valve body 12 is at the completely closed position, that is, a minimum value Vmin of the output voltage V, and a value of the output voltage V provided when the valve body 12 is at the fully open position, that is, a maximum value Vmax of the output voltage V, as in the following equation:

$$Vs=(V-Vmin)/(Vmax-Vmin)$$

Figure 7:
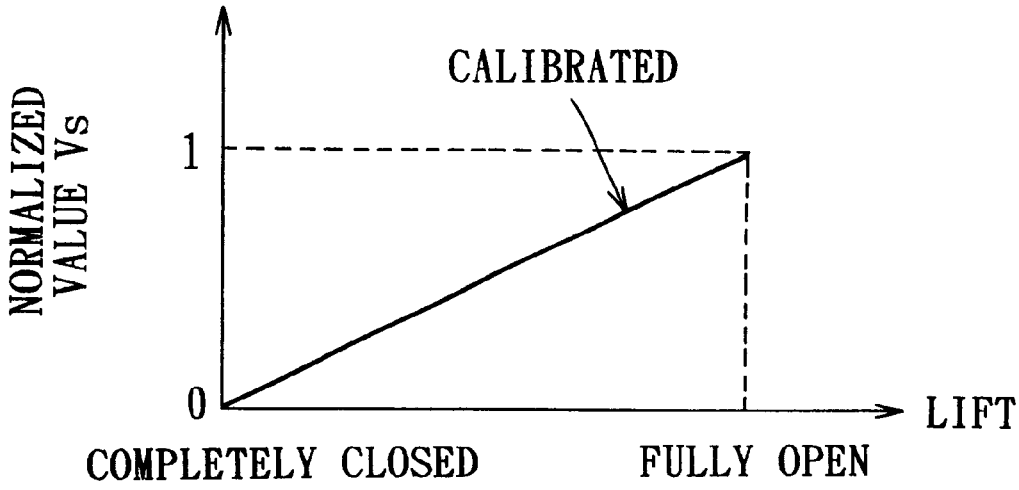
FIG. 7 indicates a relationship between the lift of the valve body detected by the construction shown in FIG. 5 and the normalized value of the output voltage.

FIG. 7 indicates a relationship between the lift of the valve body 12 and the normalized value Vs. As indicated in FIG. 7, the normalized value Vs changes within the range of 0 to 1 corresponding to the displacement of the valve body 12 between the completely closed position and the fully open position. Therefore, the use of the normalized value Vs makes it possible to precisely detect the amount of lift of the valve body 12 without being affected by the temperature drift of the gap sensors 100, 102.

The mean value of the output voltages of the gap sensors 100, 102 is used as the output voltage V. Therefore, even if the valve shaft 24 shifts in a direction of diameter of the valve shaft 24 and therefore changes the output voltages of the gap sensors 100, 102, the effect of the output voltage changes is canceled out.

The normalized value Vs is normalized so that the value Vs becomes zero when the valve body 12 is at the completely closed position. Therefore, the lift of the valve body 12 is always detected with reference to the completely closed position. Hence, even if the valve body 12 thermally expands so that the position of the tapered portion 104 relative to the gap sensors 100, 102 changes, the lift of the valve body 12 can be accurately detected without being affected by the positional change.

Figure 8:
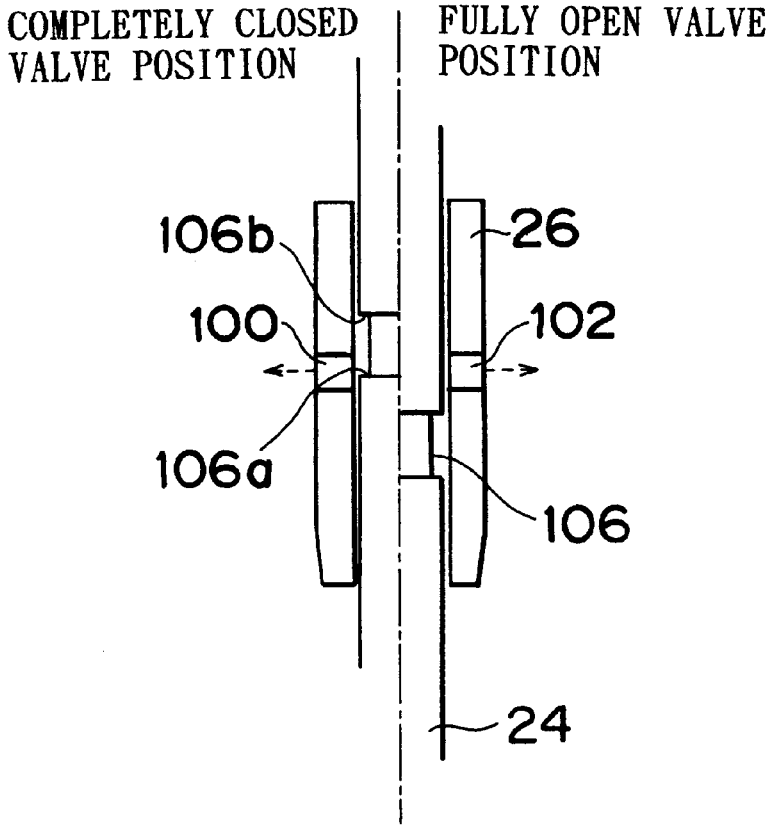
FIG. 8 shows another construction for detecting the lift of the valve body.

The lift of the valve body 12 may also be detected by employing a different construction as described below. FIG. 8 shows a construction in which instead of the tapered portion 104 shown in FIG. 5, a recess 106 having a rectangular sectional shape is formed in the valve shaft 24. The position of the recess 106 is defined so that when the valve body 12 is at the completely closed position (in a left-side half of FIG. 8), a lower step portion 106a of the valve shaft 24 faces a central portion of each gap sensor 100, 102, and so that when the valve body 12 is at the neutral position, an upper step portion 106*b* faces a central portion of each gap sensor 100, 102. Therefore, when the valve body 12 is at the fully open position (in a right-side half in FIG. 8), the upper step portion 106*b* of the valve shaft 24 is located below the gap sensors 100, 102. In this construction, as the valve body 12 is moved in the vicinity of the neutral position, the areas of the gap sensors 100, 102 that face the recess 106 correspondingly change so that the output voltage V changes. As in the construction shown in FIG. 5, the use of the normalized value Vs obtained through normalization of the output voltage V based on its maximum and minimum values eliminates the effect of the temperature drift of the gap sensors 100, 102 in the construction shown in FIG. 8.

Figure 9:
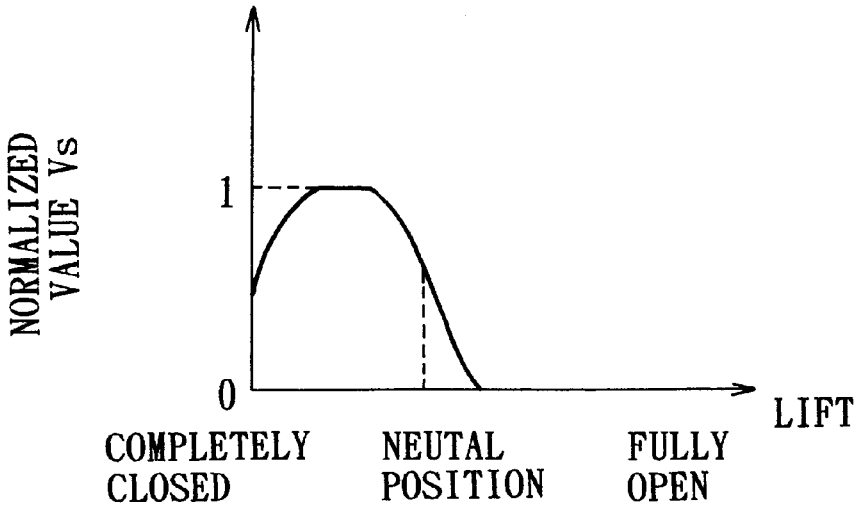
FIG. 9 indicates a relationship between the lift of the valve body detected by the construction shown in FIG. 8 and the normalized value of the output voltage.

FIG. 9 indicates a relationship between the lift of the valve body 12 and the normalized value Vs in the construction as shown in FIG. 8. As indicated in FIG. 9, when the valve body 12 moves in the vicinity of the neutral position, the normalized value Vs changes with a relatively large gradient in accordance with changes in the lift. In this case, the predetermined time T0 (see FIG. 3) is set so that the reference lift Lbase is provided near the neutral position of the valve body 12. Therefore, the construction as shown in FIG. 8 also makes it possible to detect the reference lift Lbase based on the normalized value Vs with high precision.

The construction for detecting the lift of the valve body 12 is not limited to the constructions as shown in FIGS. 5 and 8. For example, the lift of the valve body 12 may also be detected by measuring the displacement of an upper end surface of the armature shaft 36 through the use of a gap sensor or a laser distance sensor.

Figure 10:
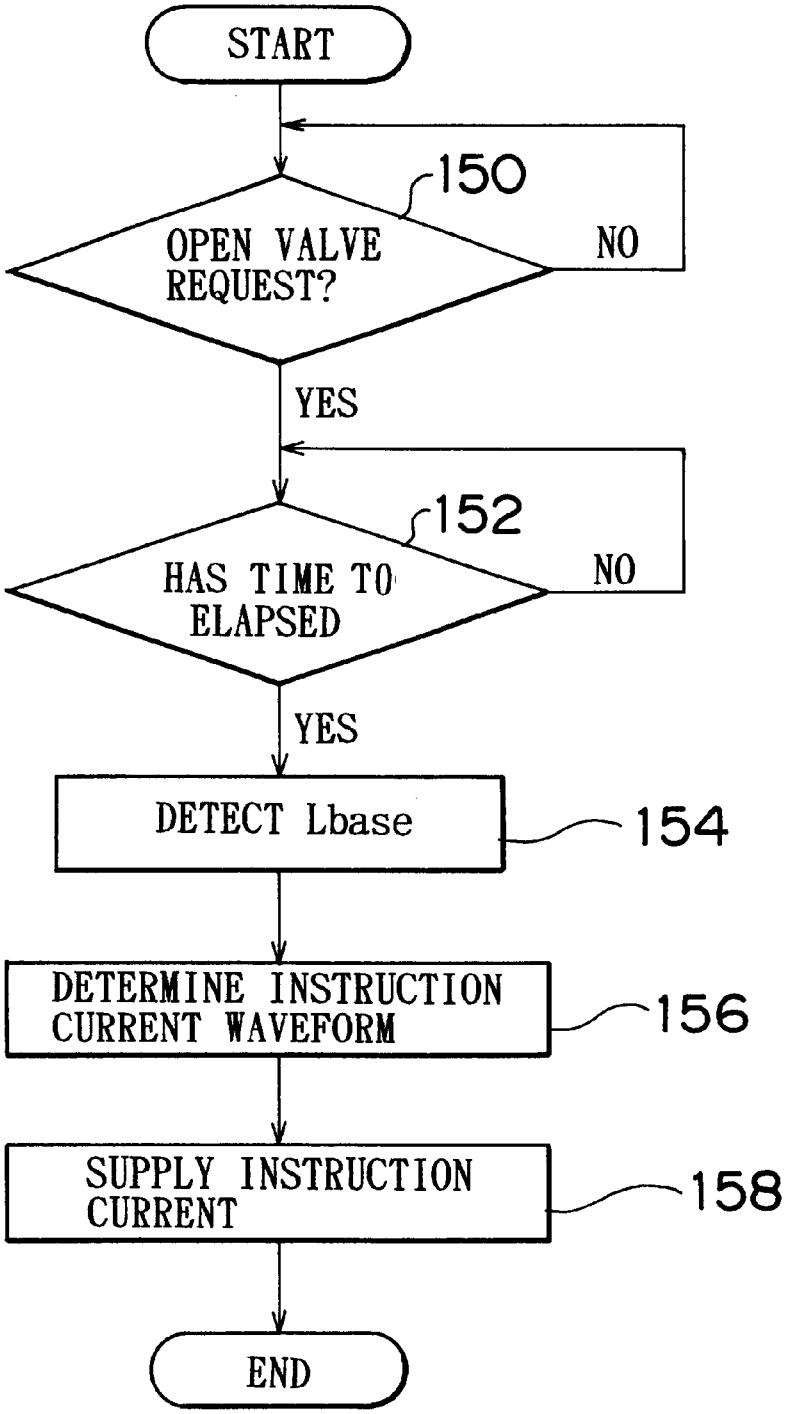
FIG. 10 is a flowchart illustrating a routine executed by an ECU in a first embodiment of the invention.

The operation executed by the ECU 70 in this embodiment will be described with reference to FIG. 10. FIG. 10 is a flowchart illustrating a routine executed by the ECU 70. This routine is a periodical interrupt routine activated at predetermined time intervals. When the routine is activated, the processing of step 150 is first executed.

In step 150, the ECU 70 determines whether a request to open the valve body 12 is present. This processing is repeatedly executed until the open valve request is outputted. If the open valve request has been outputted (YES in step 150), the process proceeds to step 152.

In step 152, the ECU 70 determines whether a predetermined time T0 has elapsed following the output of the open valve request. If the predetermined time T0 has elapsed (YES in step 152), the process proceeds to step 154.

In step 154, the ECU 70 detects a lift of the valve body 12 with reference to the completely closed position (corresponding to the reference lift Lbase).

Subsequently in step 156, the ECU 70 determines a pause period Tp, an attraction period Tatt, an attraction current Iatt, and a hold current Ihold from the reference lift Lbase based on the relationships indicated in FIGS. 4A to 4D, whereby a waveform of the instruction current I to be supplied to the lower coil 54 is determined.

Subsequently in step 158, the ECU 70 executes the processing of supplying the determined waveform of the instruction current I to the lower coil 54. After the processing of step 158 ends, the present cycle of the routine ends.

A second embodiment of the invention will now be described. In this embodiment, a waveform of the instruction current I is determined based on the elapsed time (hereinafter, referred to as "reference elapsed time Tbase") from the output of the open valve request to a time point at which the lift of the valve body 12 reaches a predetermined lift L0.

Figure 11:
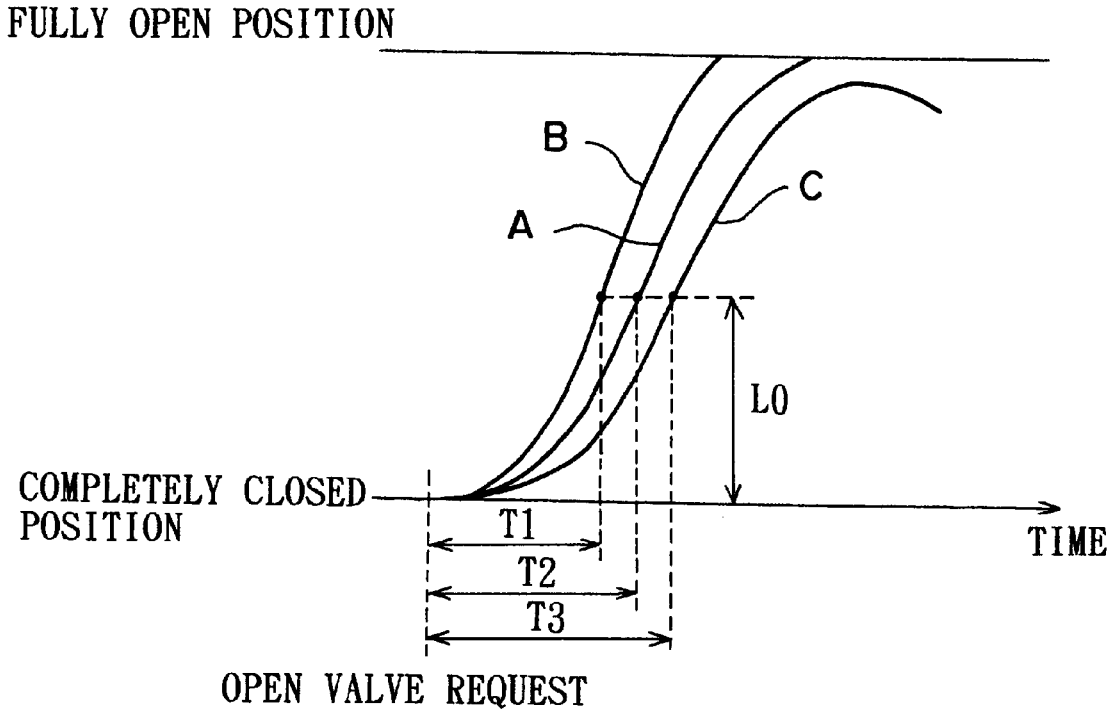
FIG. 11 indicates changes in the reference elapsed time caused by changes of external disturbances on the valve body.

FIG. 11, similar to FIG. 3, shows waveforms of lift of the valve body 12 moving from the completely closed position to the fully open position when an external disturbance on the valve body 12 varies to three different levels (A, B, C) under a condition that the waveform of the instruction current I to the lower coil 54 is fixed. As indicated in FIG. 11, the reference elapsed time Tbase changes to T1, T2, T3 in accordance with the external disturbance on the valve body 12, that is, in accordance with the kinetic energy lost by the valve body 12. That is, as the kinetic energy lost by the valve body 12 becomes less, the reference elapsed time Tbase becomes less and it becomes more appropriate to determine that the electromagnetic force applied to the armature 46 needs to be reduced. In order to reflect variations of the external disturbances on the valve body 12 in the reference elapsed time Tbase, the predetermined lift L0 is set so as to correspond substantially to the neutral position of the valve body 12, as is the case with the predetermined time T0 in the first embodiment.

FIGS. 12A to 12D indicate a relationship between the reference elapsed time Tbase and the pause period Tp, a relationship between the reference elapsed time Tbase and the attraction period Tatt, a relationship between the reference elapsed time Tbase and the attraction current Iatt, and a relationship between the reference elapsed time Tbase and the hold current Ihold, respectively. These relationships were empirically determined, as in FIGS. 4A to 4D. In the second embodiment, the parameters Tp, Tatt, Iatt, Ihold are determined based on the relationships indicated in FIGS. 12A to 12D.

Figures 12A, 12B, 12C, 12D:
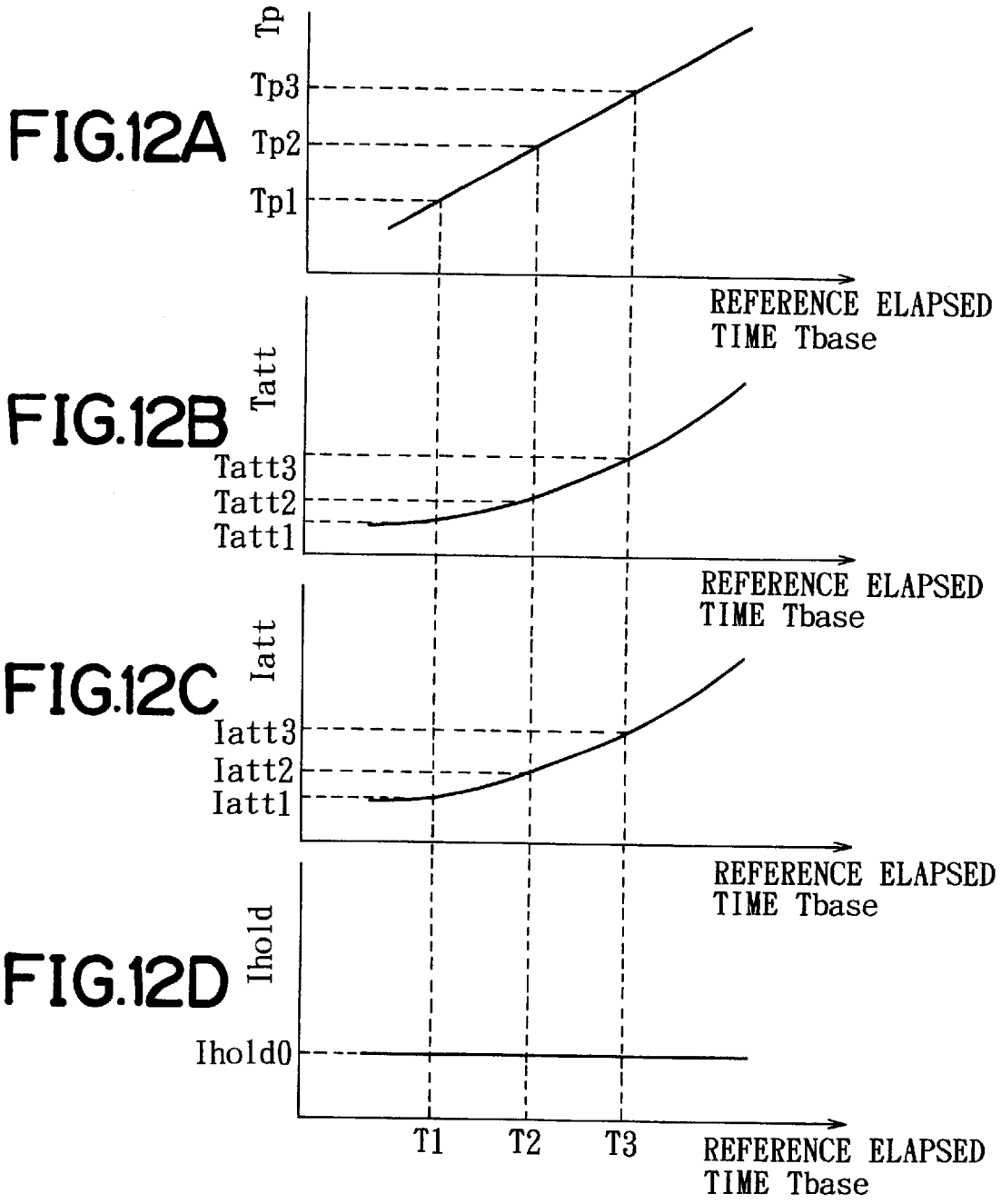
FIG. 12A shows a map indicating a relationship between the reference elapsed time and the pause period.
FIG. 12B shows a map indicating a relationship between the reference elapsed time and the attraction period.
FIG. 12C shows a map indicating a relationship between the reference elapsed time and the attraction current.
FIG. 12D shows a map indicating a relationship between the reference elapsed time and the hold current.

The pause period Tp is set so that when the valve body 12 passes the neutral position, the supply of the hold current Ihold starts. Since the predetermined lift L0 is set so as to correspond substantially to the neutral position of the valve body 12, an increase in the reference elapsed time Tbase may cause the supply of the hold current Ihold to start before the displacement of the valve body 12 reaches the predetermined lift L0. To prevent such an event, the pause period Tp is set to larger values as the reference elapsed time Tbase increases, as indicated in FIG. 12A.

The electromagnetic force to be applied to the armature 46 increases with increases of the reference elapsed time Tbase. Therefore, the attraction period Tatt and the attraction current Iatt are set to larger values as the reference elapsed time Tbase increases, as indicated in FIGS. 12B and 12C.

In contrast, the hold current Ihold hardly affects the waveform of lift of the valve body 12. Therefore, the hold current Ihold is kept at a constant value Ihold0 regardless of the reference elapsed time Tbase.

Figure 13:
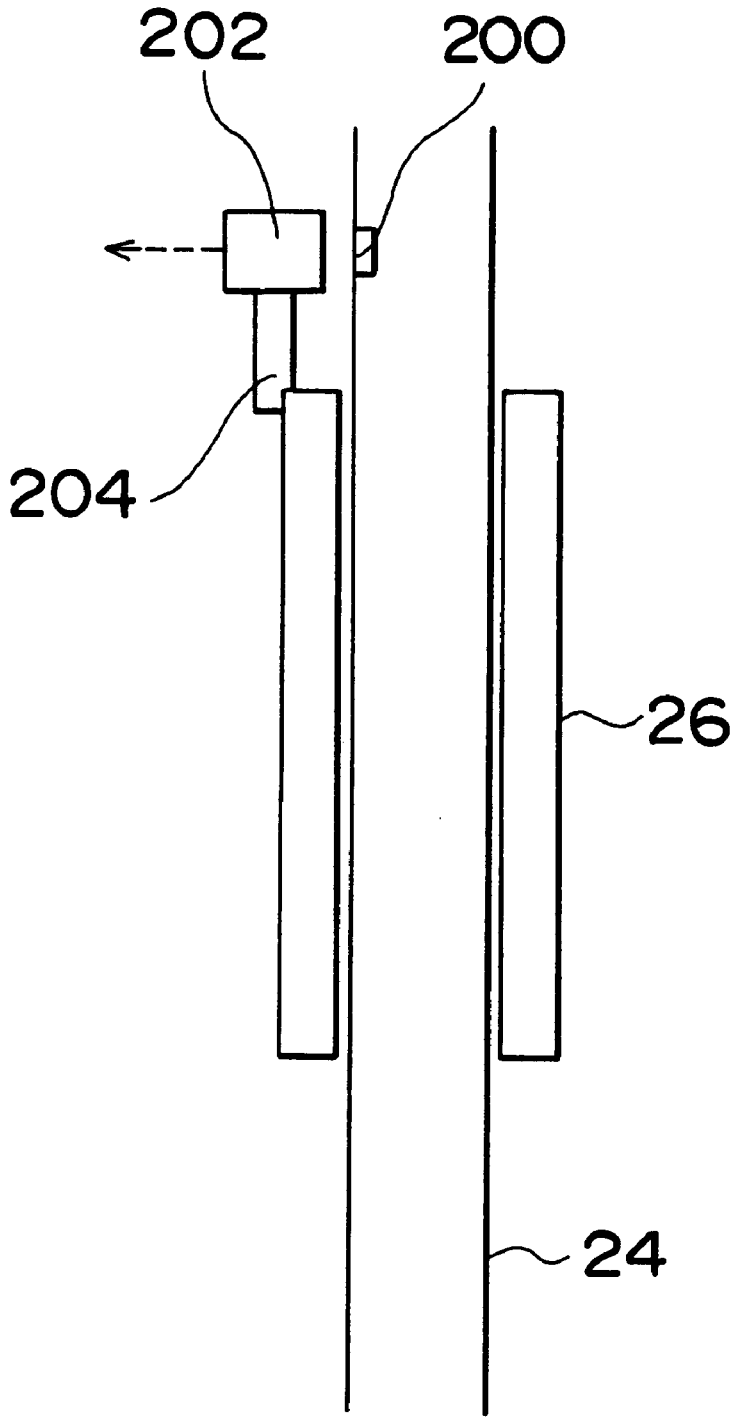
FIG. 13 illustrates a construction for detecting the lift of the valve body.

FIG. 13 illustrates a construction for detecting whether the lift of the valve body 12 has reached the predetermined lift L0. As shown in FIG. 13, a magnet 200 is disposed in an outer peripheral surface of a valve shaft 24 in this embodiment. An electromagnetic pickup 202 is disposed near the valve shaft 24. The electromagnetic pickup 202 is retained to an upper end portion of a valve guide 26 by a retainer member 204. An output signal of the electromagnetic pickup 202 is inputted to the ECU 70. The magnet 200 and the retainer member 204 are disposed so that they face each other when the lift of the valve body 12 with reference to the completely closed position reaches the predetermined lift L0. Therefore, based on the output signal of the electromagnetic pickup 202, the ECU 70 is able to detect the timing at which the lift of the valve body 12 with reference to the completely closed position reaches the predetermined lift L0. The magnet 200 may be provided in the armature shaft 36, instead of the valve shaft 24.

Thus, this embodiment requires a simpler construction to detect the reference elapsed time Tbase than the first embodiment, in which the reference lift Lbase is detected. The second embodiment may also adopt a construction as shown in FIG. 5 or 8 to detect the amount of lift of the valve body 12, as in the first embodiment.

Figure 14:
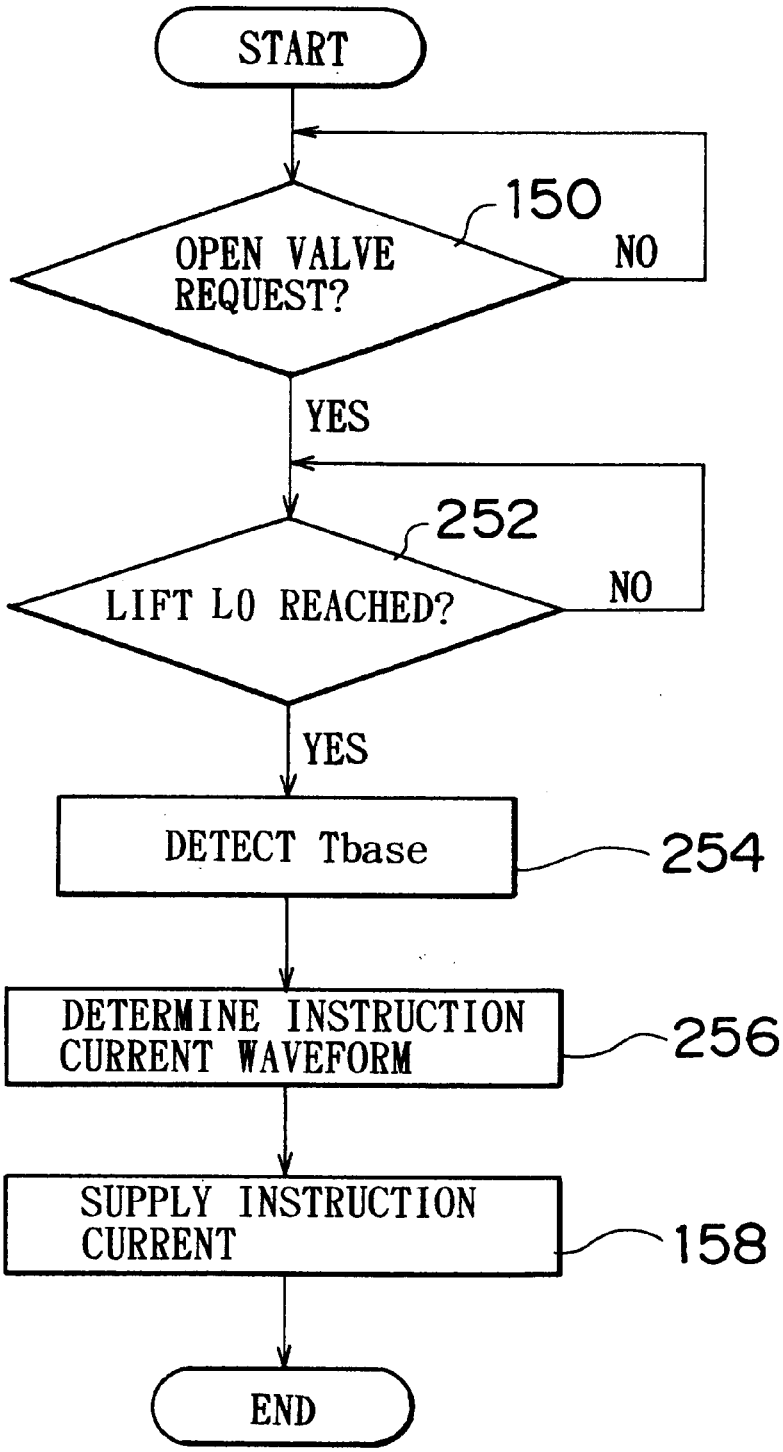
FIG. 14 is a flowchart illustrating a routine executed by the ECU in a second embodiment of the invention.

The operation executed by the ECU 70 in this embodiment will be described with reference to FIG. 14. FIG. 14 is a flowchart illustrating a routine executed by the ECU 70. The routine illustrated in FIG. 14 is a periodical interrupt routine activated at predetermined time intervals. Processing steps comparable to those in the routine of FIG. 10 are represented by comparable reference numerals in FIG. 14, and will not be described again. In the routine of FIG. 14, if it is determined in step 150 that the open valve request has been outputted, the process proceeds to step 252.

In step 252, the ECU 70 determines whether the lift of the valve body 12 has reached the predetermined lift L0. The processing of step 252 is repeatedly executed until the predetermined lift L0 is reached. When the lift of the valve body 12 has reached the predetermined lift L0, the process proceeds to step 254.

In step 254, the ECU 70 detects an elapsed time following the output of the open valve request. The elapsed time detected in this step corresponds to the reference elapsed time Tbase.

Subsequently in step 256, the ECU 70 determines a pause period Tp, an attraction period Tatt, an attraction current Iatt, and a hold current Ihold based on the reference elapsed time Tbase with reference to the relationships indicated in FIGS. 12A to 12D. After that, the ECU 70 executes the processing of step 158, and then ends the present cycle of the routine.

A third embodiment of the invention will now be described.

In this embodiment, a delay time is estimated based on the lift of the valve body 12 provided at the elapse of a predetermined time following the output of the request to open the valve body 12. In accordance with the estimated delay time, the pause period Tp is increased.

As mentioned above, the core-retaining space 64 is supplied with lubricating oil for lubricating the bushes 60, 62 and the armature shaft 36. The lubricating oil deposits in the form of oil films on surfaces of the armature 46, the upper core 48 and the lower core 52. Therefore, when the armature 46 separates from the upper core 48 (that is, when the valve body 12 starts to lift from the completely closed position), the surface tension in oil films produces on the armature 46 a force that impedes displacement of the armature 46. This force causes a time delay between the output of the request to open the valve body 12 and the start of displacement of the armature 46 and the valve body 12. The magnitude of the time delay varies depending on the state of deposit of oil films and the like.

Due to the PWM control of the instruction current I to the upper coil 50 and the lower coil 54 performed by the drive circuit 56, the value of current always fluctuate at small amplitudes even when the constant hold current Ihold is supplied. Therefore, when the instruction current I to the upper coil 50 is switched from the attraction current Iatt to the hold current Ihold in response to the open valve request, the value of the hold current Ihold varies depending on the timing of the switching. This also causes variation of the delay time of the start of displacement of the armature 46 and the valve body 12.

A delay occurs between the output of the request to open the valve body 12 and the actual start of displacement of the armature 46 and the valve body 12, and the delay time (hereinafter, referred to as "delay time ΔT") tends to vary. Therefore, if the instruction current I is supplied to the upper coil 50 and the lower coil 54 at the same timing (that is, if the pause period Tp is always kept fixed), the variation of the delay time ΔT fluctuates the position assumed by the valve body 12 at the time of the start of the supply of the attraction current Iatt. In this case, the electromagnetic force applied to the armature 46 changes due to changes in the distance between the armature 46 and the upper core 48 (or the lower core 52). Therefore, there is a possibility that the displacement velocity of the valve body 12 when reaching the fully open position will increase, or that the valve body 12 will fail to reach the fully open position or the completely closed position.

In this embodiment, therefore, a delay time ΔT is estimated based on the lift of the valve body 12 provided at the elapse of a predetermined time Ta following the output of the request to open the valve body 12. In accordance with the delay time ΔT, the pause period Tp is increased.

FIG. 15A shows waveforms of the lift of the valve body 12 moving from the completely closed position to the fully open position, wherein a solid line (1) shows a waveform without a delay time ΔT, and a broken line (2) shows a waveform with a delay time ΔT1, and a one-dot chain line (3) shows a waveform with a delay time ΔT2. In FIG. 15A, ΔT1<ΔT2. FIGS. 15B and 15C show waveforms of the instruction current I supplied to the upper coil 50 and the lower coil 54, respectively.

As is apparent from the FIG. 15A, as the delay time ΔT increases, the lift of the valve body 12 provided at the elapse of the predetermined time Ta following the output of the open valve request, that is, following the start of supply of the attraction current Iatt to the upper coil 50 as indicated in FIG. 15B (hereinafter, referred to as "initial lift La"), decreases. Therefore, in this embodiment, the relationship between the initial lift La and the delay time ΔT is empirically determined as indicated in FIG. 16, and is stored beforehand. With reference to the stored relationship, the delay time ΔT is estimated from the initial lift La. Then, a value obtained by adding the delay time ΔT to a value of the pause period Tp that provides an optimal waveform of valve lift when the delay time ΔT is zero (hereinafter, referred to as "reference pause period Tp0") is used as an actual pause period Tp. Therefore, the supply of the attraction current Iatt can be started at a position of a constant lift of the valve body 12 regardless of the magnitude of the delay time ΔT.

By increasing the pause period Tp in accordance with the delay time ΔT, the embodiment is able to start supplying the attraction current Iatt at a time point at which the valve body 12 reaches a fixed position, regardless of the delay time ΔT. Therefore, the embodiment is able to control the displacement velocity of the valve body 12 at or near the fully open position to a reduced velocity so as to reduce the operation noise level of the electromagnetic drive valve 10 while ensuring the displacement of the valve body 12 to the fully open position.

As mentioned in conjunction with the first and second embodiments, the waveform of lift of the valve body 12 also changes due to fluctuations of the external disturbances on the valve body 12. However, the effect of the external disturbances on the lift of the valve body 12 is small immediately after the valve body 12 starts moving from the completely closed position. Therefore, in order to exclude the effect of external disturbances and estimate an accurate delay time ΔT, it is desirable to set the predetermined time Ta to as small a value as possible. However, if the predetermined time Ta is excessively small, there arises a possibility that the valve body 12 remains still at the elapse of the predetermined time Ta. Considering these points, the predetermined time Ta is set to as small a value as possible on condition that at the elapse of the set value of the predetermined time Ta, it can be determined, without a fail, that the valve body 12 has started moving from the completely closed position. In the electromagnetic drive valve 10 of this embodiment, the delay time ΔT is within the range of 0 to 0.5 ms, and therefore the predetermined time Ta is set to, for example, 1 ms.

Figure 17:
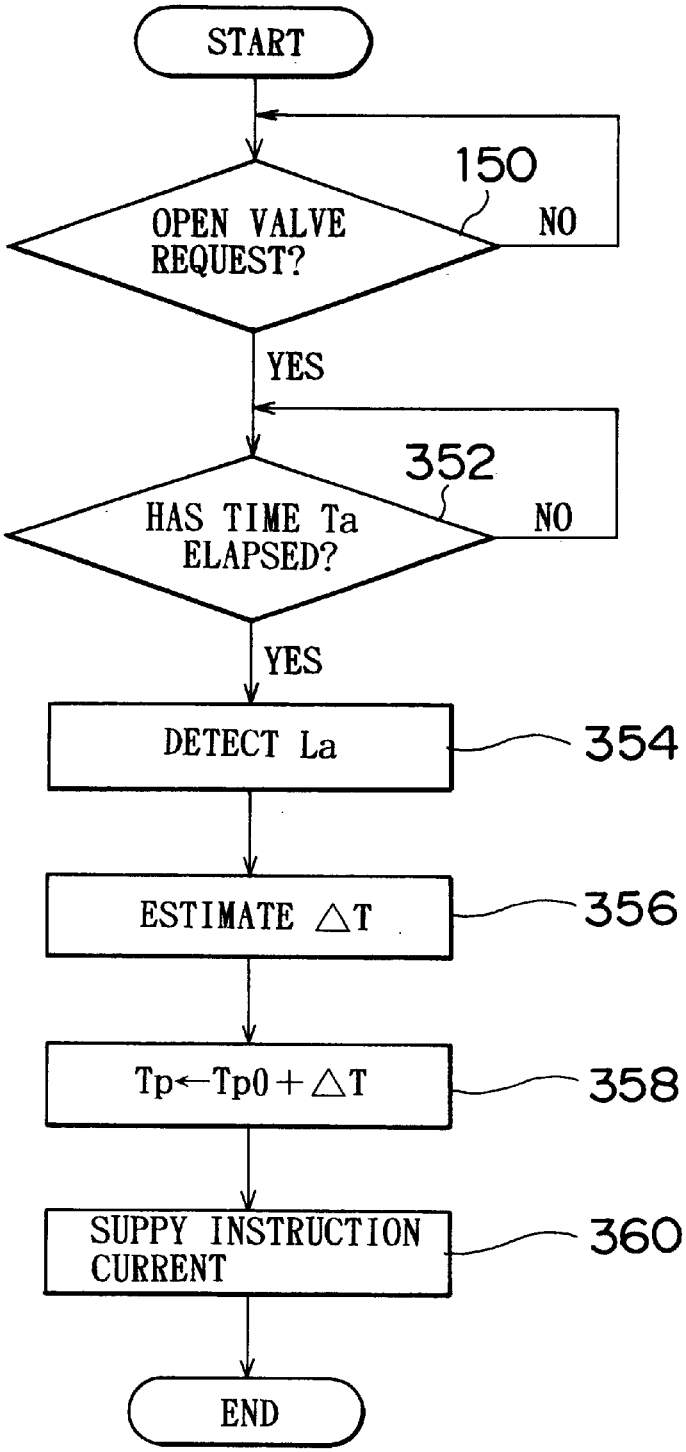
FIG. 17 is a flowchart illustrating a routine executed by the ECU in a third embodiment of the invention.

The operation executed by the ECU 70 in this embodiment will be described with reference to FIG. 17. FIG. 17 is a flowchart illustrating a routine executed by the ECU 70. The routine illustrated in FIG. 17 is a periodical interrupt routine activated at predetermined time intervals. Processing steps comparable to those in the routine of FIG. 10 are represented by comparable reference numerals in FIG. 17, and will not be described again. In the routine of FIG. 17, if it is determined in step 150 that the open valve request has been outputted, the process proceeds to step 352.

In step 352, the ECU 70 determines whether the predetermined time Ta has elapsed following the output of the open valve request. The processing of step 352 is repeatedly executed until the predetermined time Ta elapses. When it is determined in step 352 that the predetermined time Ta has elapsed, the process proceeds to step 354.

In step 354, the ECU 70 detects a lift of the valve body 12 (corresponding to the initial lift La).

Subsequently in step 356, the ECU 70 determines a delay time ΔT based on the initial lift La by referring to the relationship indicated in FIG. 16.

Subsequently in step 358, the ECU 70 sets the pause period Tp to a value obtained by adding the delay time ΔT to the reference pause period Tp0.

Subsequently in step 360, the ECU 70 executes the processing of supplying the lower coil 54 with a waveform of the instruction current I defined by using the pause period Tp set in the step 358. After step 360, the ECU 70 ends the present cycle of the routine.

Although in this embodiment, the pause period Tp is set based on the delay time ΔT, it is also possible to compensate for changes in the delay time ΔT by starting to supply the attraction current Iatt at a time point at which the valve body 12 reaches a fixed point near the neutral position.

A fourth embodiment of the invention will now be described.

The third embodiment is unable to determine a delay time ΔT if the delay time ΔT exceeds the predetermined time Ta. Therefore, in the fourth embodiment, the delay time ΔT is directly determined from the time elapsing before the lift of the valve body 12 reaches a predetermined lift Lb. That is, an elapsed time Tb0 to a time point at which the lift of the valve body 12 reaches the predetermined lift Lb in a case where the delay time ΔT is zero is determined beforehand. A difference between the elapsed time Tb0 and an actually measured elapsed time is determined as a delay time ΔT.

Therefore, it becomes possible to determine a delay time ΔT regardless of the magnitude of the delay time ΔT.

Figure 18:
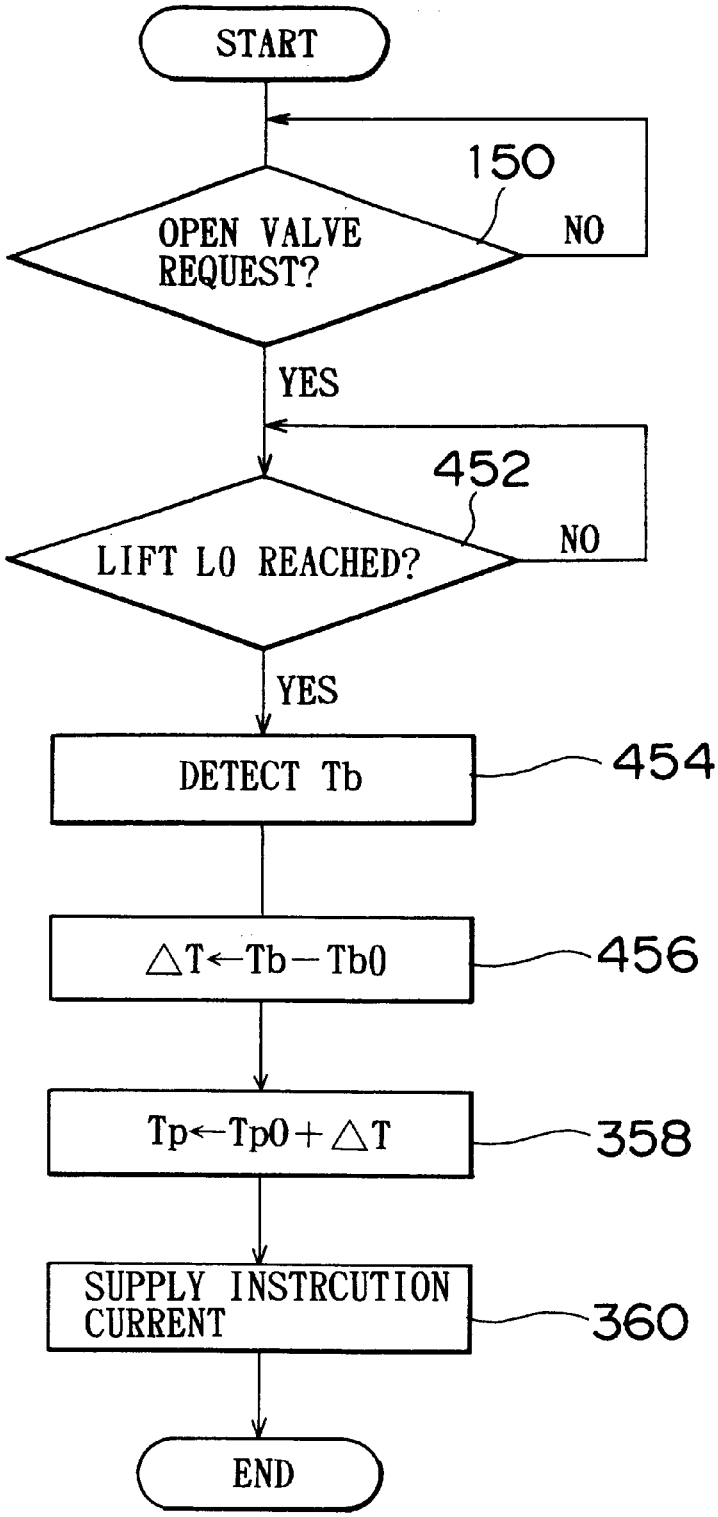
FIG. 18 is a flowchart illustrating a routine executed by the ECU in a fourth embodiment of the invention.

FIG. 18 is a flowchart illustrating a routine executed by the ECU 70. The routine illustrated in FIG. 18 is a periodical interrupt routine activated at predetermined time intervals. Processing steps comparable to those in the routine of FIG. 17 are represented by comparable reference numerals in FIG. 18, and will not be described again. In the routine of FIG. 18, if it is determined in step 150 that the open valve request has been outputted, the process proceeds to step 452.

In step 452, the ECU 70 determines whether the lift of the valve body 12 has reached the predetermined lift Lb. The processing of step 452 is repeatedly executed until the predetermined lift Lb is reached. When it is determined in step 452 that the lift of the valve body 12 has reached the predetermined lift Lb, the process proceeds to step 454.

In step 454, the ECU 70 detects an elapsed time (elapsed time Tb) following the output of the open valve request.

Subsequently in step 456, the ECU 70 determines a delay time ΔT based on the detected elapsed time Tb and the stored elapsed time Tb0 (ΔT=Tb−Tb0). After step 456, the ECU 70 executes the processing of steps 358 and 360, and then ends the present cycle of the routine.

In the third and fourth embodiments, it is also possible to compensate for the effect of external disturbances on the valve body 12 by setting an attraction period Tatt and an attraction current Iatt based on the reference lift Lbase or the reference elapsed time Tbase as in the first or second embodiment, in addition to setting a pause period Tp based on the delay time ΔT.

A fifth embodiment of the invention will now be described.

This embodiment discriminates the effect of external disturbances on the valve body 12 and the effect of the delay time ΔT by using the displacement velocity of the valve body 12, so that a further optimal waveform of the delay time ΔT can be provided.

As is apparent from FIG. 3 or 11, a change of the external disturbances causes a change in the waveform of lift of the valve body 12. As the external disturbance increases, the gradient of the waveform of valve lift at a fixed lift decreases. Furthermore, as indicated in FIG. 15A, if the delay time ΔT changes, the waveform of valve lift shifts parallel to the axis of time. The gradient of the waveform at a fixed lift remains unchanged regardless of the value of the delay time ΔT. Therefore, the effect of the delay time ΔT is not reflected in the displacement velocity of the valve body 12 at a certain lift, but the effect of the external disturbances on the valve body 12 is reflected therein. In contrast, substantially only the effect of the delay time ΔT is reflected in the elapsed time to the predetermined lift Lb immediately after the start of lift of the valve body 12.

Therefore, this embodiment estimates a delay time ΔT from the elapsed time Tb elapsing before the lift of the valve body 12 reaches the predetermined lift Lb, and determines a pause period Tp based on the delay time ΔT. Furthermore, the embodiment determines an attraction period Tatt and an attraction current Iatt based on a average velocity V0 of the valve body 12 before the lift of the valve body 12 reaches the predetermined lift Lb, which corresponds to a position close to the neutral position.

It is to be noted herein that the displacement velocity of the valve body 12 becomes maximum in the vicinity of the neutral position. Therefore, the average velocity V0 of the valve body 12 before the predetermined lift Lb corresponding to a point close to the neutral position reflects the effect of the external disturbance on the valve body 12 to a relatively great extent. Therefore, the use of the average velocity V0 makes it possible to precisely compensate for the effect of changes in the external disturbance on the valve body 12.

Figure 19A:
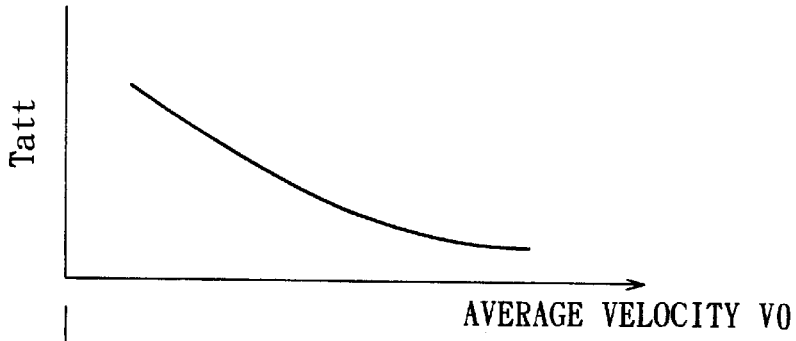
FIG. 19A indicates a relationship between the average velocity of the valve body and the attraction period.
Figure 19B:
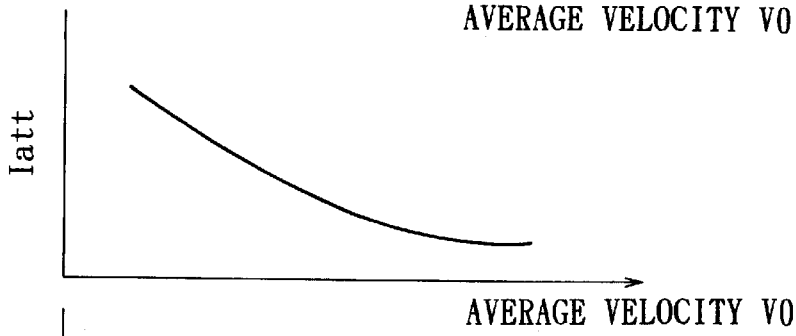
FIG. 19B indicates a relationship between the average velocity of the valve body and the attraction current.
Figure 19C:
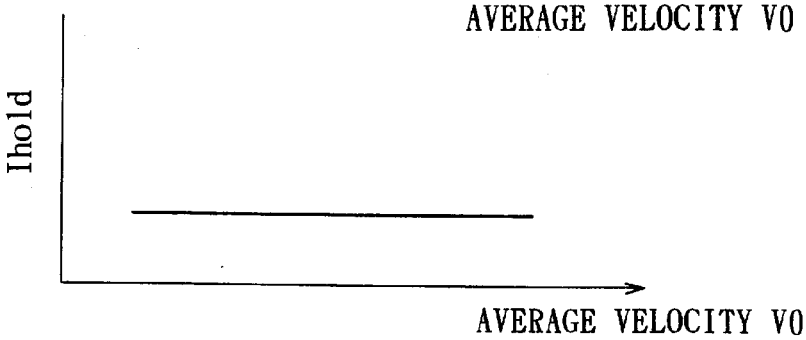
FIG. 19C indicates a relationship between the average velocity of the valve body and the hold current.

FIGS. 19A to 19C indicate a relationship between the average velocity V0 and the attraction period Tatt, a relationship between the average velocity V0 and the attraction current Iatt, and a relationship between the average velocity V0 and the hold current Ihold, respectively. These relationships were obtained by empirically determining such values of the parameters Tatt, Iatt, Ihold as to provide optimal waveforms of valve lift under various conditions with different external disturbances on the valve body 12.

As mentioned above, the displacement velocity of the valve body 12 during a fixed period decreases with increases of external disturbances that impede displacement of the valve body 12 (i.e., with increases of the kinetic energy lost by the valve body 12). Therefore, as indicated in FIGS. 19A and 19B, the attraction period Tatt and the attraction current Iatt are set so as to increase with decreases in the average velocity V0. The hold current Ihold is kept at a constant value Ihold0 regardless of the average velocity V0 because the hold current Ihold has substantially no effect on the waveform of valve lift. As in the third and fourth embodiments, the pause period Tp is determined by adding a delay time ΔT to the reference pause period Tp0.

Figure 20:
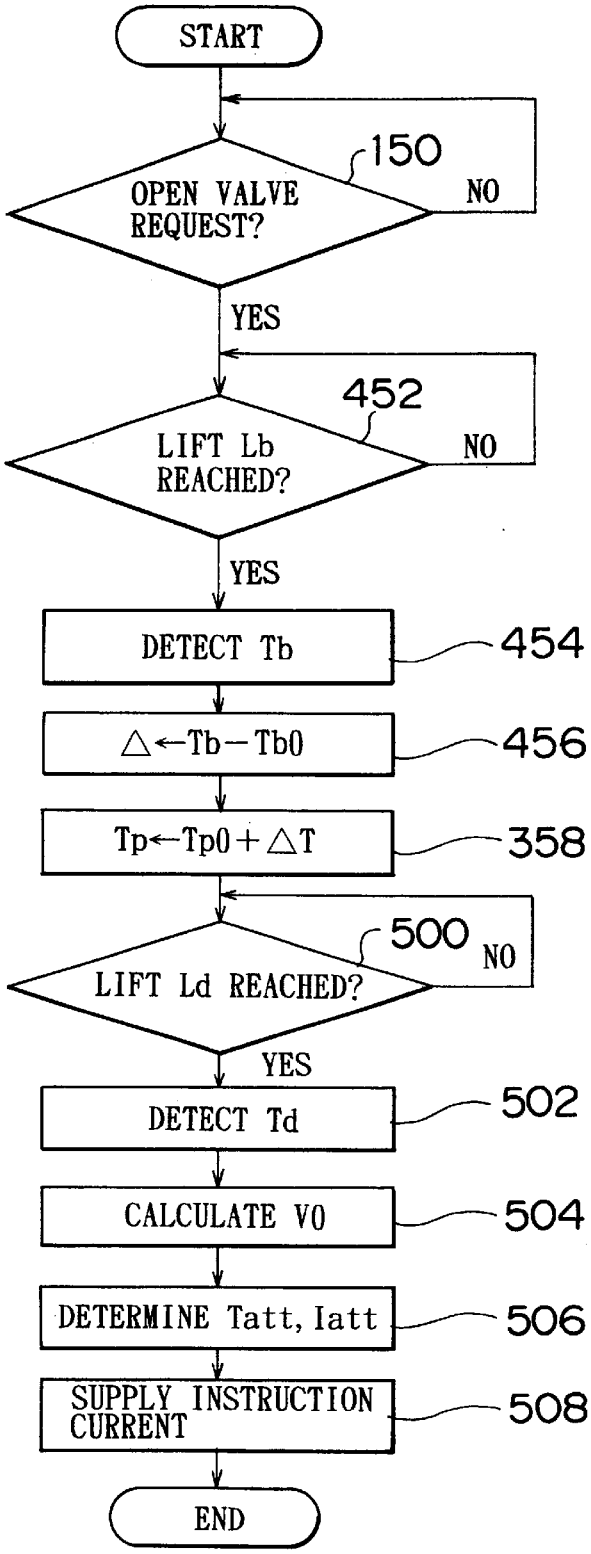
FIG. 20 is a flowchart illustrating a routine executed by the ECU in a fifth embodiment of the invention.

FIG. 20 is a flowchart illustrating a routine executed by the ECU 70 in this embodiment. Processing steps comparable to those in the routine of FIG. 18 are represented by comparable reference numerals in FIG. 20, and will not be described again. In the routine of FIG. 20, after a pause period Tp is determined in step 358, the process proceeds to step 500.

In step 500, the ECU 70 determines whether the lift of the valve body 12 has reached a predetermined lift Ld. The processing of step 500 is repeatedly executed until the predetermined lift Ld is reached. When it is determined in step 500 that the predetermined lift Ld is reached, the process proceeds to step 502.

In step 502, the ECU 70 detects an elapsed time (corresponding to the elapsed time Td) following the output of the request to open the valve body 12.

Subsequently in step 504, the ECU 70 calculates a average velocity V0 as in the following equation:

$$V0=(Ld-Lb)/(Td-Tb)$$

Subsequently in step 506, ECU 70 determines an attraction period Tatt and an attraction current Iatt based on the relationships indicated in FIGS. 19A and 19B, whereby a waveform of the instruction current I to be supplied to the lower coil 54 is determined.

Subsequently in step 508, the ECU 70 executes the processing of supplying the waveform of the instruction current I determined in step 506. After step 508, the ECU 70 ends the present cycle of the routine.

Although in the embodiment, the pause period Tp is determined based on the elapsed time Tb to a time point at which the lift of the valve body 12 reaches the predetermined lift Lb, the pause period Tp may also be determined based on the initial lift La provided at the elapse of the predetermined time Ta following the output of the open valve request as in the third embodiment.

The waveform of the instruction current I may also be determined by using an instantaneous velocity of the valve body 12 at a time point at which the lift of the valve body 12 reaches the predetermined lift Ld, instead of using the average velocity V0. The velocity of the valve body 12 may be determined, for example, from the changing rate of the lift within a small time slot close to the time point at which the predetermined lift Ld is reached. It is also possible to provide a velocity sensor for directly detecting the velocity of the valve body 12.

The embodiment determines an average velocity of the valve body 12 between two points on the course of displacement of the valve body 12 and, based on the average velocity, compensates for changes of the external disturbances on the valve body 12. However, if the change of the displacement velocity of the valve body 12 caused by changes of external disturbances vary in a complicated manner depending on the position of the valve body 12, it is difficult to completely compensate for the changes of external disturbances on the basis of the average velocity of the valve body 12 between two points. In such a case, therefore, the waveform of the instruction current I may be determined by using the lift of the valve body 12 detected at three or more points.

Although the first to fifth embodiments use a waveform of the instruction current I as shown in FIG. 2A, the waveform of the instruction current I is not limited to that shown in FIG. 2A. For example, a waveform in which the attraction current Iatt changes in two or more steps may be used. In this case, too, the parameters that define the waveform of the instruction current I may be changed based on the position assumed by the valve body 12 at or after the elapse of a predetermined time, or the like.

As shown in FIG. 1, the ECU 70 is preferably implemented on a program3ed general purpose computer. However, the ECU 70 can also be implemented on a special purpose computer, a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA or PAL, or the like. In general, any device, capable of implementing a finite state machine that is in turn capable of implementing the flowcharts shown in FIGS. 10, 14, 17, 18 and 20, can be used to implement the ECU 70.

While the invention has been described with reference to preferred embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the invention.

What is claimed is:

1. An electromagnetic drive valve, comprising:

a valve body that is movable between a first displacement end and a second displacement end based on a displacement request;

an electromagnet that attracts an armature that cooperates with the valve body;

a current supply that supplies a current to the electromagnet;

a position detector that detects a position of the valve body between the first displacement end and the second displacement end when the valve body is moved from the first displacement end toward the second displacement end; and a controller that changes a waveform of the current to be supplied from the current supply to the electromagnet, based on at least the position of the valve body detected by the position detector, wherein the position detector at least detects the position of the valve body at an elapse of a first predetermined time after an output of the displacement request and at an elapse of a second predetermined time after the output of the displacement request, the second predetermined time being longer than the first predetermined time.

2. An electromagnetic drive valve according to claim 1, further comprising a velocity detector that detects a velocity of the valve body when the valve body is between the position detected by the position detector and the second displacement end, wherein the controller changes the waveform of the current to be supplied from the current supply to the electromagnet, based on at least the position detected by the position detector and the velocity detected by the velocity detector.

3. An electromagnetic drive valve according to claim 1, further comprising a time detector that detects an elapsed time from an output of the displacement request to a time point at which the valve body reaches at least one position located between the first displacement end and the second displacement end, wherein the controller changes the waveform of the current to be supplied from the current supply to the electromagnet, based on at least the elapsed time detected by the time detector, and wherein the controller changes at least one of a timing of starting to supply the current, an amount of the current, and a duration of supplying the current.

4. An electromagnetic drive valve according to claim 1, wherein the controller changes at least one of a timing of starting to supply the current, an amount of the current, and a duration of supplying the current.

5. An electromagnetic drive valve according to claim 1, further comprising a velocity detector that detects a velocity of the valve body at least at one position located between the first displacement end and the second displacement end after the displacement request is output, wherein the controller changes the waveform of the current to be supplied from the current supply to the electromagnet, based on at least the velocity detected by the velocity detector.

6. An electromagnetic drive valve according to claim 5, wherein the controller changes at least one of a timing of starting to supply the current, an amount of the current, and a duration of supplying the current.

7. An electromagnetic drive valve, comprising:

a valve body that is movable between a first displacement end and a second displacement end based on a displacement request;

an electromagnet that attracts an armature that cooperates with the valve body;

a current supply that supplies a current to the electromagnet;

a position detector that detects a position of the valve body between the first displacement end and the second displacement end when the valve body is moved from the first displacement end toward the second displacement end;

a controller that changes a waveform of the current to be supplied from the current supply to the electromagnet, based on at least the position of the valve body detected by the position detector; and a time detector that detects an elapsed time from an output of the displacement request, to a time point at which the valve body reaches at least one position located between the first displacement end and the second displacement end, wherein the controller changes the waveform of the current to be supplied from the current supply to the electromagnet, based on at least the elapsed time detected by the time detector, and wherein the time detector at least detects a first elapsed time to a first time point at which the valve body reaches a position that is located at a first distance from the first displacement end, and a second elapsed time to a second time point at which the valve body reaches a second position that is located at a second distance from the first displacement end, the second distance being greater than the first distance.

8. An electromagnetic drive valve according to claim 1, further comprising a velocity detector that detects a velocity of the valve body when the valve body reaches a position that is located at a predetermined distance from the at least one position at which the time detector detects the elapsed time, wherein the controller changes the waveform of the current to be supplied from the current supply to the electromagnet, based on at least the elapsed time detected by the time detector and the velocity of the valve body detected by the velocity detector.

9. An electromagnetic drive valve according to claim 7, wherein the controller changes at least one of a timing of starting to supply the current, an amount of the current, and a duration of supplying the current.

10. A method for controlling an electromagnetic drive valve including a valve body that is movable between a first displacement end and a second displacement end based on a displacement request and an electromagnet that attracts an armature that cooperates with the valve body, the method comprising:

supplying a current to the electromagnet;

detecting a position of the valve body between the first displacement end and the second displacement end when the valve body is moved from the first displacement end toward the second displacement end; and changing a waveform of the current to be supplied to the electromagnet, based on at least the detected position of the valve body, wherein detecting the position of the valve body at least includes detecting the position of the valve body at an elapse of a first predetermined time after an output of the displacement request and at an elapse of a second predetermined time after the output of the displacement request, the second predetermined time being longer than the first predetermined time.

11. A method according to claim 10, further comprising detecting a velocity of the valve body when the valve body is between the detected position and the second displacement end, changing the waveform of the current to be supplied from the current supply to the electromagnet, based on at least the detected position and the detected velocity.

12. A method according the claim 10, further comprising detecting an elapsed time from an output of the displacement request to a time point at which the valve body reaches at least one position located between the first displacement end and the second displacement end; and changing the waveform of the current to be supplied to the electromagnet, based on at least the detected elapsed time, wherein changing the elapsed time includes detecting a first at least one of a changing timing of starting to supply the current, changing an amount of the current, and changing a duration of supplying the current.

13. A method according to claim 10, wherein changing the waveform includes changing at least one of a timing of starting to supply the current, an amount of the current, and a duration of supplying the current.

14. A method according to claim 10, further comprising detecting a velocity of the valve body at least at one position located between the first displacement end and the second displacement end after the displacement request is outputted, and changing the waveform of the current to be supplied changing the waveform includes to the electromagnet, based on at least the detected velocity.

15. A method according to claim 14, wherein changing the waveform includes at least one of changing a timing of starting to supply the current, changing an amount of the current, and changing a duration of supplying the current.

16. A method for controlling an electromagnetic drive valve including a valve body that is movable between a first displacement end and a second displacement end based on a displacement request and an electromagnet that attracts an armature that cooperates with the valve body, the method comprising:

supplying a current to the electromagnet;

detecting a position of the valve body between the first displacement end and the second displacement end when the valve body is moved from the first displacement end;

changing the waveform of the current to be supplied to the electromagnet, based on at least the detected position of the valve body detecting an elapsed time from an output of the displacement request to a time point at which the valve body reaches at least one position between the first displacement end and the second displacement end; and changing the waveform of the current to be supplied to the electromagnet, based on at least the detected elapsed time, wherein detecting the elapsed time at least includes detecting a first elapsed time to a first time point at which the valve body reaches a first position that is located at a first distance from the first displacement end, and detecting a second elapsed time to a second time point at which the valve body reaches a second position that is located at a second distance from the first displacement end, the second distance being greater than the first distance.

17. A method according to claim 16, further comprising detecting a velocity of the valve body when the valve body reaches a position that is located at a predetermined distance from the at least one position at which the elapsed time is detected, and changing the waveform of the current to be supplied to the electromagnet, based at least on the detected elapsed time detected by the time detector and the detected velocity of the valve body.

18. An electromagnetic drive valve, comprising:

a valve body that is movable between a first displacement end and a second displacement end based on a displacement request;

an electromagnet that attracts an armature that cooperates with the valve body;

a current supply that supplies a current to the electromagnet;

a position detector that detects a position of the valve body between the first displacement end and the second displacement end when the valve body is moved from the first displacement end toward the second displacement end; and a controller that changes a waveform of the current to be supplied from the current supply to the electromagnet, based on at least the position of the valve body detected by the position detector, wherein the controller takes the reference lift (Lbase) as the variable, in advance memorizes relationships between the reference lift (Lbase) and a pause period (Tp), between the reference lift (Lbase) and an attraction period (Tatt), between the reference lift (Lbase) and an attraction current (Iatt), and the reference lift (Lbase) and a hold current (Ihold), and changes the waveform of the current based on the relationships.

19. A method for controlling an electromagnetic drive valve including a valve body that is movable between a first displacement end and a second displacement end based on a displacement request and an electromagnet that attracts an armature that cooperates with the valve body, the method comprising:

supplying a current to the electromagnet;

detecting a position of the valve body between the first displacement end and the second displacement end when the valve body is moved from the first displacement end toward the second displacement end;

changing a waveform of the current to be supplied to the electromagnet, based on at least the detected position of the valve body; and taking the reference lift (Lbase) as the variable, in advance memorizing relationships between the reference lift (Lbase) and a pause period (Tp), between the reference lift (Lbase) and an attraction period (Tatt), between the reference lift (Lbase) and an attraction current (Iatt), and the reference lift (Lbase) and a hold current (Ihold), and changing the waveform of the current based on the relationships.

20. An electromagnetic drive valve, comprising:

a valve body that is movable between a first displacement end and a second displacement end based on a displacement request;

an electromagnet that attracts an armature that cooperates with the valve body;

a current supply that supplies a current to the electromagnet;

a position detector that detects a position of the valve body between the first displacement end and the second displacement end when the valve body is moved from the first displacement end toward the second displacement end;

a controller that changes a waveform of the current to be supplied from the current supply to the electromagnet, based on at least the position of the valve body detected by the position detector; and a time detector that detects an elapsed time from an output of the displacement request to a time point at which the valve body reaches at least one position located between the first displacement end and the second displacement end, wherein the controller changes the waveform of the current to be supplied from the current supply to the electromagnet, based on at least the elapsed time detected by the time detector, and wherein the controller takes the reference elapsed time (Tbase) as the variable, in advance memorizes relationships between the reference elapsed time (Tbase) and a pause period (Tp), between the reference elapsed time (Tbase) and an attraction period (Tatt), between the reference elapsed time (Tbase) and an attraction current (Iatt), and the reference elapsed time (Tbase) and a hold current (Ihold), and changes the waveform of the current based on the relationships.

21. A method for controlling an electromagnetic drive valve including a valve body that is movable between a first displacement end and a second displacement end based on a displacement request and an electromagnet that attracts an armature that cooperates with the valve body, the method comprising:

supplying a current to the electromagnet;

detecting a position of the valve body between the first displacement end and the second displacement end when the valve body is moved from the first displacement end toward the second displacement end;

detecting an elapsed time from an output of the displacement request to a time point at which the valve body reaches at least one position located between the first displacement end and the second displacement end;

changing the waveform of the current to be supplied to the electromagnet, based on at least the detected position of the valve body and the detected elapsed time; and taking the reference elapsed time (Tbase) as the variable, in advance memorizing relationships between the reference elapsed time (Tbase) and a pause period (Tp), between the reference elapsed time (Tbase) and an attraction period (Tatt), between the reference elapsed time (Tbase) and an attraction current (Iatt), and the reference elapsed time (Tbase) and a hold current (Ihold), and changing the waveform of the current based on the relationships.

* * * * *